US010813419B1

(12) United States Patent
Lin

(10) Patent No.: US 10,813,419 B1
(45) **Date of Patent: *Oct. 27, 2020**

(54) ZIPPER HEAD ASSEMBLY STRUCTURE

(71) Applicant: CHUNG CHWAN ENTERPRISE CO., LTD., Taoyuan (TW)

(72) Inventor: Yu-Pau Lin, Taoyuan (TW)

(73) Assignee: CHUNG CHWAN ENTERPRISE CO., LTD., Taoyuan (TW)

( * ) Notice: Subject to any disclaimer, the term of this patent is extended or adjusted under 35 U.S.C. 154(b) by 0 days.

This patent is subject to a terminal disclaimer.

(21) Appl. No.: 16/565,498

(22) Filed: Sep. 10, 2019

(30) Foreign Application Priority Data

Apr. 3, 2019 (TW) ..... 108111977 A

(51) Int. Cl.
*A44B 19/30* (2006.01)
*A44B 19/26* (2006.01)

(52) U.S. Cl.
CPC ..... *A44B 19/301* (2013.01); *A44B 19/262* (2013.01)

(58) Field of Classification Search
CPC ... A44B 19/301; A44B 19/262; A44B 19/308; Y10T 24/2577; Y10T 24/2571; Y10T 24/2566
See application file for complete search history.

(56) References Cited

U.S. PATENT DOCUMENTS 3,793,684 A * 2/1974 Moertel ..... A44B 19/26 24/421
3,924,306 A * 12/1975 Oda ..... A44B 19/308 24/424
5,544,394 A * 8/1996 Yaguramaki ..... A44B 19/308 24/424
5,809,622 A * 9/1998 Yaguramaki ..... A44B 19/308 24/421
6,314,624 B1 * 11/2001 Lin ..... A44B 19/308 24/421
6,497,016 B1 * 12/2002 Lin ..... A44B 19/308 24/418
6,510,594 B2 * 1/2003 Lin ..... A44B 19/308 24/419
9,844,246 B2 * 12/2017 Yamagishi ..... A44B 19/30
D822,538 S * 7/2018 Lin ..... D11/221
(Continued)

FOREIGN PATENT DOCUMENTS

CN 207898052 U 9/2018
TW 365751 U 8/1999
TW M565991 U 9/2018

*Primary Examiner* — Robert Sandy
*Assistant Examiner* — Rowland Do
(74) *Attorney, Agent, or Firm* — Li & Cai Intellectual Property Office

(57) ABSTRACT

A zipper head assembly structure includes a sliding member and a pull member. The sliding member includes a sliding element, an elastic member, and a locking hook, the sliding element has a base portion, a first lateral wall portion, a second lateral wall portion, and a seat portion, and an inner surface of the seat portion is configured with at least one retaining block. The first lateral wall portion and the second lateral wall portion respectively extend upward from opposite side ends of the base portion, mutually corresponding to each other, and are connected to a front end of the base portion. The seat portion is disposed on the base portion and connected to a rear end of the base portion.

10 Claims, 24 Drawing Sheets

(56) References Cited

U.S. PATENT DOCUMENTS

| | | | | |
|---|---|---|---|---|
| 10,070,705 | B2 * | 9/2018 | Lin | A44B 19/262 |
| 10,092,066 | B2 * | 10/2018 | Lin | A44B 19/306 |
| 2002/0189057 | A1 * | 12/2002 | Lin | A44B 19/308 24/421 |
| 2006/0075611 | A1 * | 4/2006 | Yamagishi | A44B 19/306 24/418 |
| 2007/0169321 | A1 * | 7/2007 | Lin | A44B 19/308 24/421 |
| 2014/0123445 | A1 * | 5/2014 | Jung | A44B 19/308 24/424 |
| 2017/0035154 | A1 * | 2/2017 | Lin | F16B 2/22 |

* cited by examiner

ZIPPER HEAD ASSEMBLY STRUCTURE

CROSS-REFERENCE TO RELATED PATENT APPLICATION

This application claims the benefit of priority to Taiwan Patent Application No. 108111977, filed on Apr. 3, 2019. The entire content of the above identified application is incorporated herein by reference.

Some references, which may include patents, patent applications and various publications, may be cited and discussed in the description of this disclosure. The citation and/or discussion of such references is provided merely to clarify the description of the present disclosure and is not an admission that any such reference is "prior art" to the disclosure described herein. All references cited and discussed in this specification are incorporated herein by reference in their entireties and to the same extent as if each reference was individually incorporated by reference.

FIELD OF THE DISCLOSURE

The present disclosure relates to an assembly structure, and more particularly to a zipper head assembly structure.

BACKGROUND OF THE DISCLOSURE

Basic fastening components of common items of clothing are rarely anything other than buttons or zippers. Compared to buttons, the zipper structure has better usability and stronger structural characteristics. A general zipper structure includes a zipper head adopting a zipper tape as a guiding part for the reciprocating pulling of the zipper structure, so that the zipper structure has become more popular in clothing and accessories. However, zipper heads in the related art still have room for improvement.

SUMMARY OF THE DISCLOSURE

In response to the above-referenced technical inadequacies, the present disclosure provides a zipper head assembly structure.

In one aspect, the present disclosure provides a zipper head assembly structure including a sliding member and a pull member. The sliding member includes a sliding element, an elastic member, and a locking hook, the sliding element has a base portion, a first lateral wall portion, a second lateral wall portion, and a seat portion, and an inner surface of the seat portion is configured with at least one retaining block. The first lateral wall portion and the second lateral wall portion respectively extend upward from opposite side ends of the base portion, mutually corresponding to each other, and are connected to a front end of the base portion. The seat portion is disposed on the base portion and connected to a rear end of the base portion, and includes a through positioning opening located between the first lateral wall portion and the second lateral wall portion, and the elastic member is disposed on the seat portion to elastically abut the locking hook. One end of the locking hook has a positioning portion passing through the through positioning opening, another end of the locking hook has a retaining portion, and the at least one retaining block fixes the retaining portion in place in place.

Therefore, one of the beneficial effects of the present disclosure is that, by the technical features of "the inner surface of the seat portion being provided with at least one retaining block" and "another end of the locking hook having the retaining portion, and the at least one retaining block fixes the retaining portion in place," the retaining portion is limited by the at least one retaining block and can be movably fixed onto a predetermined plane.

These and other aspects of the present disclosure will become apparent from the following description of the embodiment taken in conjunction with the following drawings and their captions, although variations and modifications therein may be affected without departing from the spirit and scope of the novel concepts of the disclosure.

BRIEF DESCRIPTION OF THE DRAWINGS

The present disclosure will become more fully understood from the following detailed description and accompanying drawings.

DETAILED DESCRIPTION OF THE EXEMPLARY EMBODIMENTS

Figure 1:
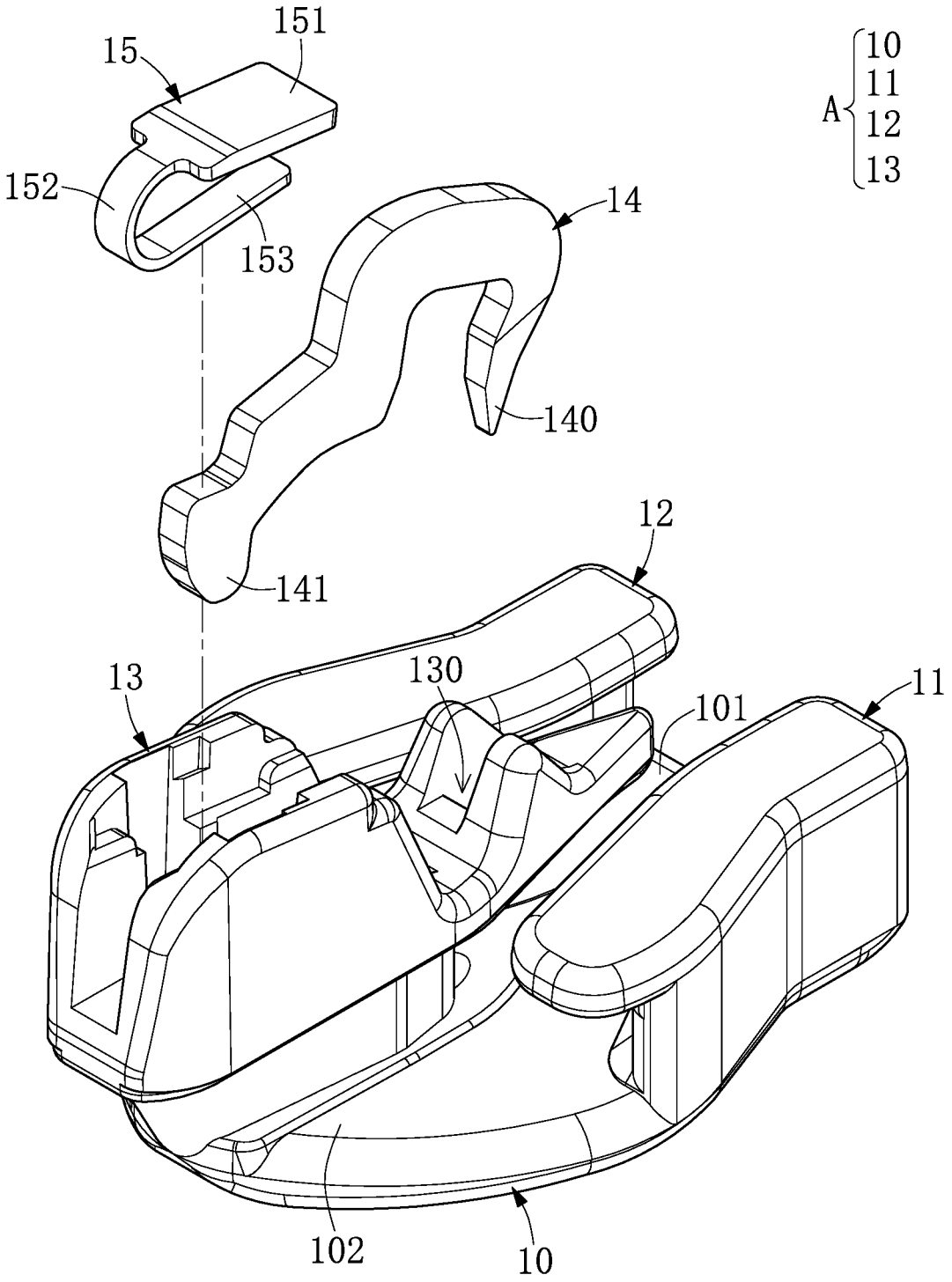
FIG. 1 is an exploded perspective schematic view of a sliding assembly (with an elastic member not yet being riveted and retained by a seat portion) according to a first embodiment of the present disclosure.

The present disclosure is more particularly described in the following examples that are intended as illustrative only since numerous modifications and variations therein will be apparent to those skilled in the art. Like numbers in the drawings indicate like components throughout the views. As used in the description herein and throughout the claims that follow, unless the context clearly dictates otherwise, the meaning of "a", "an", and "the" includes plural reference, and the meaning of "in" includes "in" and "on". Titles or subtitles can be used herein for the convenience of a reader, which shall have no influence on the scope of the present disclosure.

The terms used herein generally have their ordinary meanings in the art. In the case of conflict, the present document, including any definitions given herein, will prevail. The same thing can be expressed in more than one way. Alternative language and synonyms can be used for any term(s) discussed herein, and no special significance is to be placed upon whether a term is elaborated or discussed herein. A recital of one or more synonyms does not exclude the use of other synonyms. The use of examples anywhere in this specification including examples of any terms is illustrative only, and in no way limits the scope and meaning of the present disclosure or of any exemplified term. Likewise, the present disclosure is not limited to various embodiments given herein. Numbering terms such as "first", "second" or "third" can be used to describe various components, signals or the like, which are for distinguishing one component/signal from another one only, and are not intended to, nor should be construed to impose any substantive limitations on the components, signals or the like.

First Embodiment

Referring to FIG. 1 to FIG. 13, a first embodiment of the present disclosure provides a sliding member 1 (such as a sliding head or a slide fastener head), and the sliding member 1 includes a base portion 10, a first lateral wall portion 11, a second lateral wall portion 12, a seat portion 13, a locking hook 14 (such as a hook body or a horse-like hook), and an elastic member 15. The base portion 10, the first lateral wall portion 11, the second lateral wall portion 12 and the seat portion 13 cooperate with each other to form a sliding member A.

Figure 9:
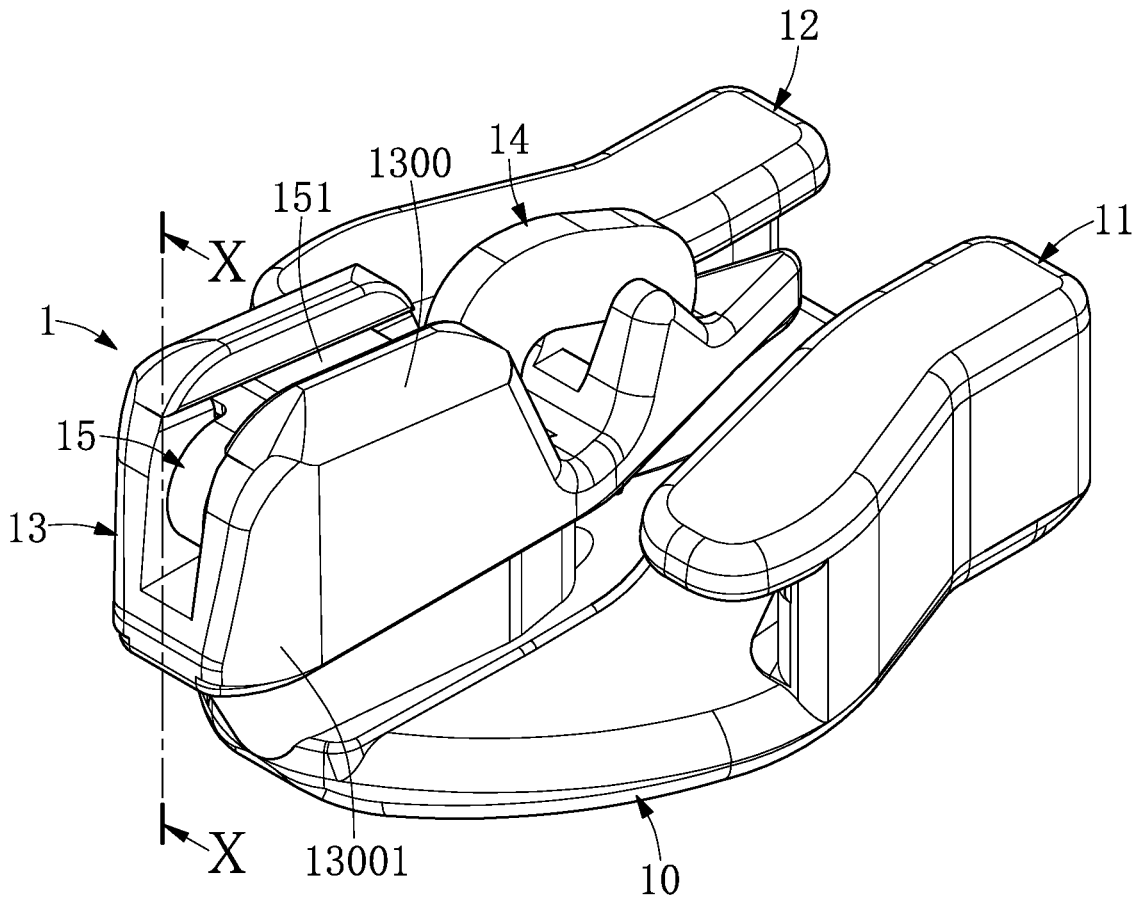
FIG. 9 is an assembled perspective schematic view of the sliding assembly (with the elastic member being riveted and retained by the top of the seat portion) according to the first embodiment of the present disclosure.
Figure 10:
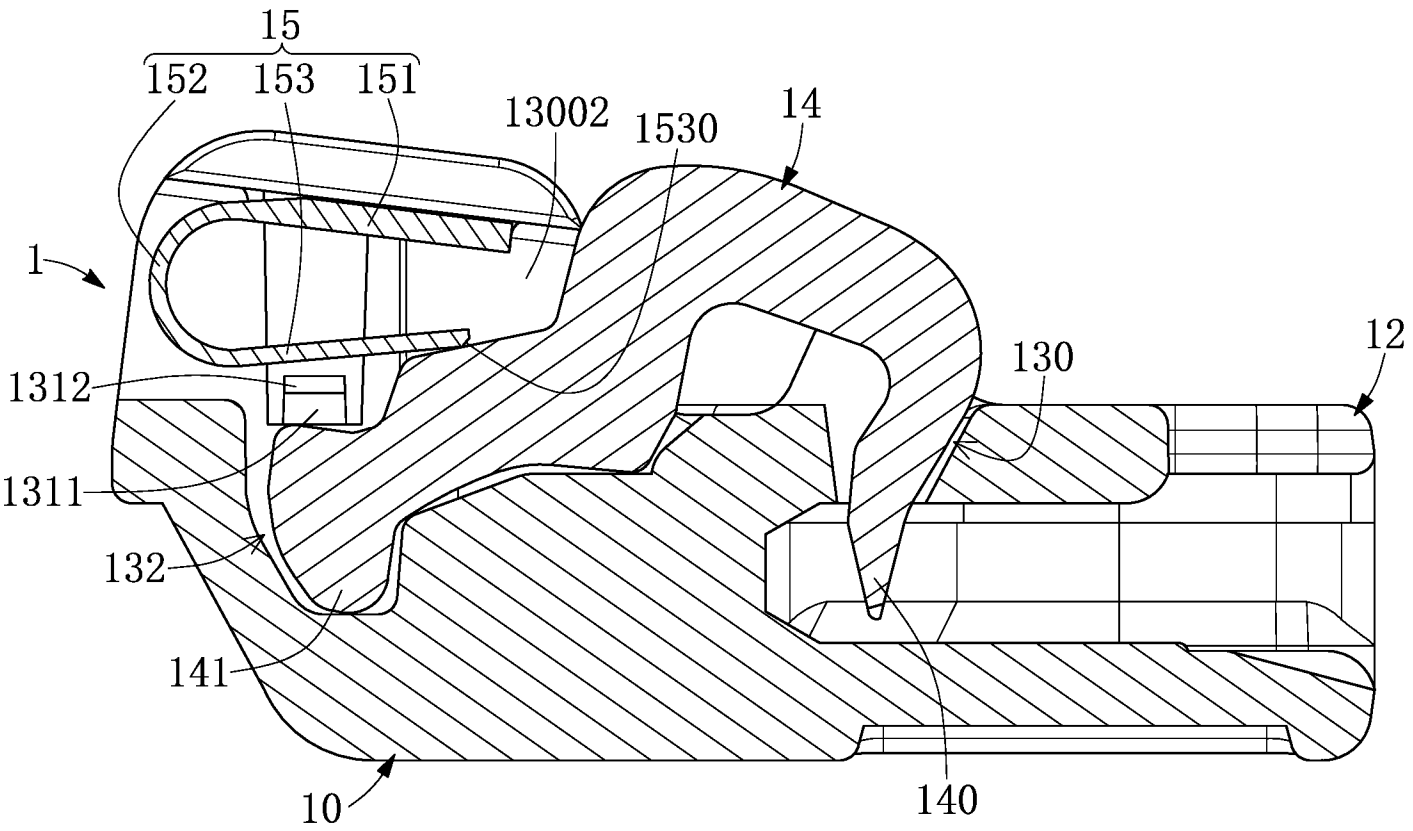
FIG. 10 is a cross-sectional view taken along the section line X-X of FIG. 9.
Figure 11:
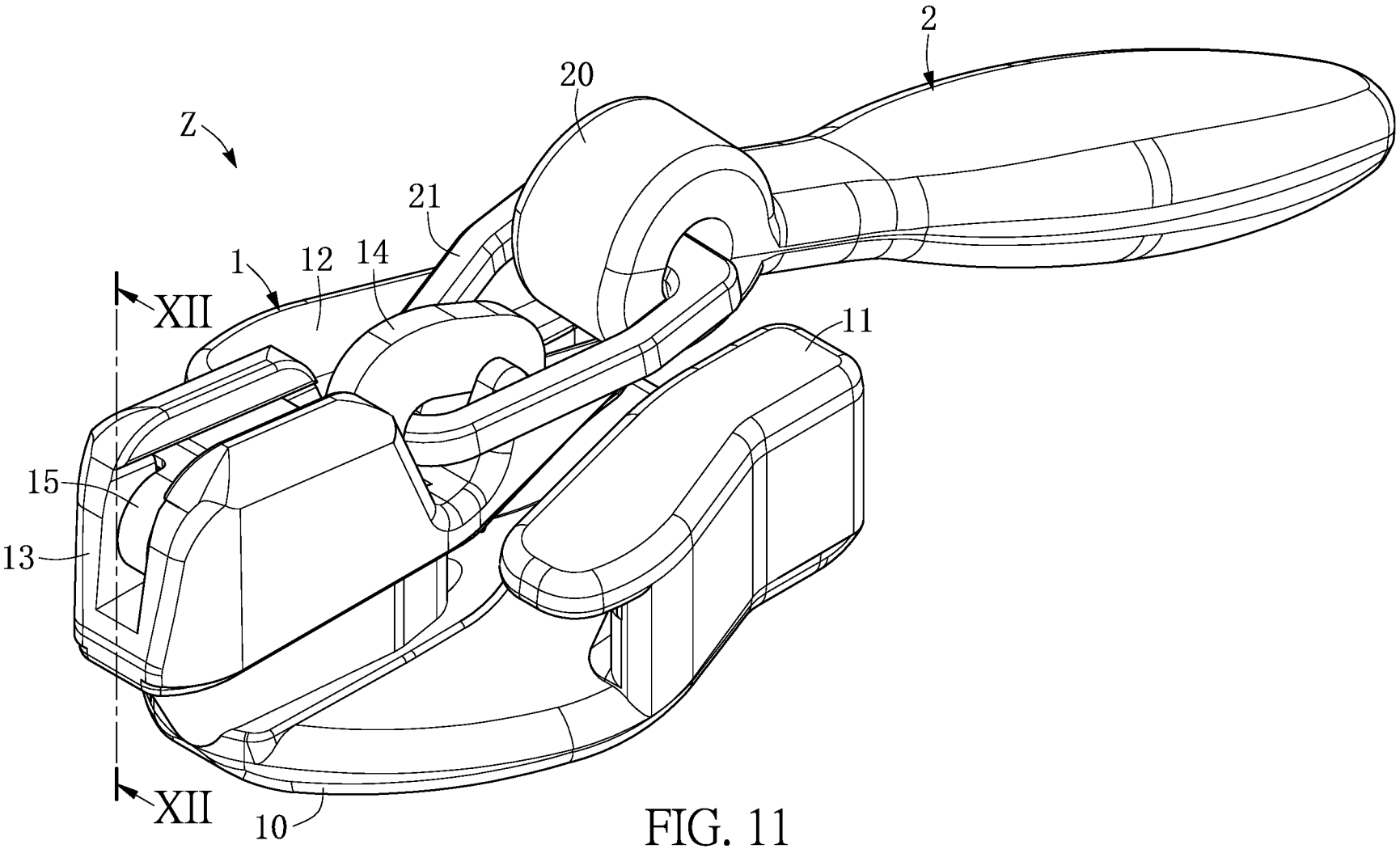
FIG. 11 is a perspective schematic view of a zipper head assembly structure according to the first embodiment of the present disclosure.

Referring to FIG. 1, FIG. 9 and FIG. 10, the first lateral wall portion 11 and the second lateral wall portion 12 respectively extend upward from opposite side ends of the base portion 10, and the first lateral wall portion 11 and the second lateral wall portion 12 correspond to each other and are connected to a front end 101 of the base portion 10. In addition, the base seat 13 is disposed on the base portion 10 and connected to a rear end 102 of the base portion 10, and the base seat 13 includes a through positioning opening 130 between the first lateral wall portion 11 and the second lateral wall portion 12. Further, the elastic member 15 is disposed on the seat portion 13 to elastically abut against the locking hook 14, and the elastic member 15 has a fixed portion 151 fixed onto the seat portion 13, an elastic portion 152 extending from the fixed portion 151, and an abutting portion 153 extending from the elastic portion 152 and abutting against the locking hook 14. Furthermore, the locking hook 14 is movably disposed on the seat portion 13 and movably contacts the abutting portion 153 of the elastic member 15, one end of the movable retaining element 14 includes a positioning portion 140 that passes through the through positioning opening 130, and another end of the locking hook 14 has a retaining portion 141.

Figure 2:
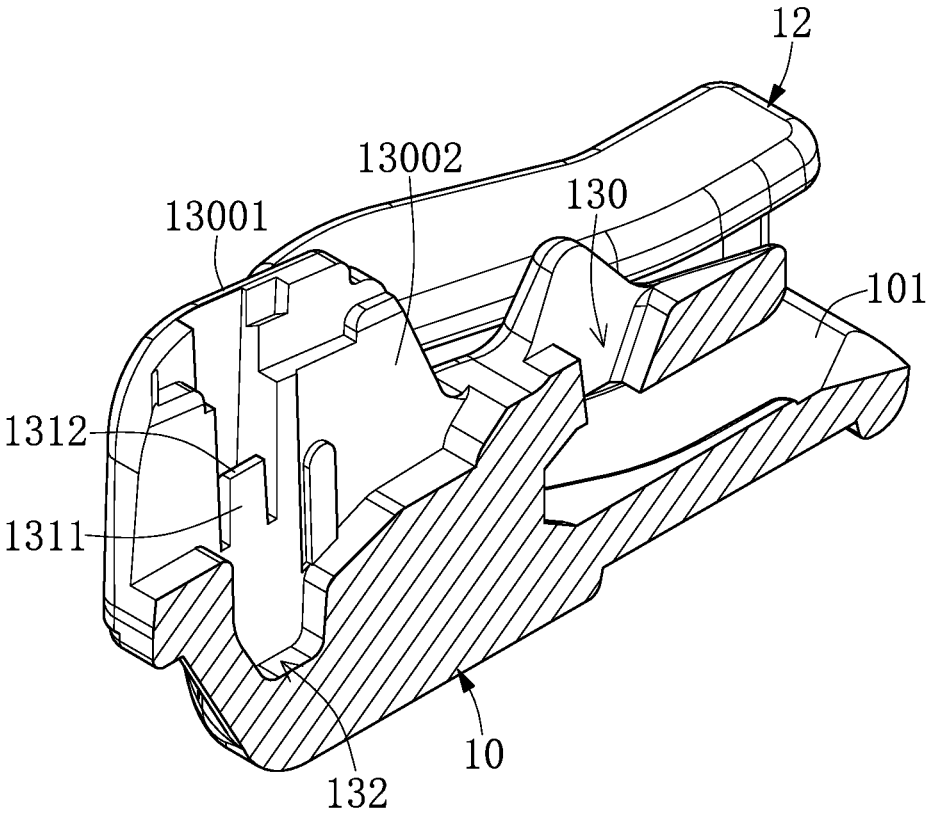
FIG. 2 is a perspective cross-sectional view of the sliding element according to the first embodiment of the present disclosure.
Figure 3:
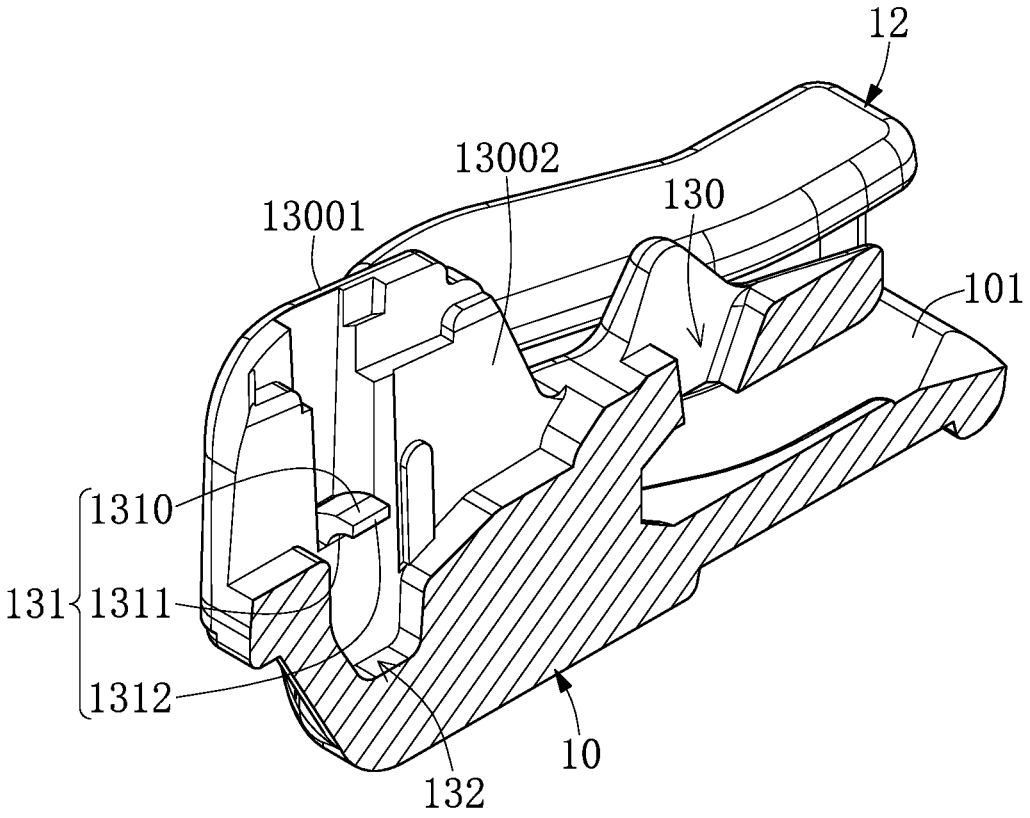
FIG. 3 is a perspective cross-sectional view of the sliding element according to the first embodiment of the present disclosure.

It should be noted that, as shown in FIG. 1 to FIG. 4 and FIG. 10, an inner surface 13002 of the seat portion 13 is provided with at least one retaining block 131, the retaining block 131 extends outward from the inside of the seat portion 13, and the retaining block 131 is parallel to the inner surface 13002 of the seat portion 13 (as shown in FIG. 2). In addition, the retaining block 131 may be curved in an arc relative to the inner surface 13002 of the seat portion 13 (as shown in FIG. 3), and at least one retaining block 131 is fixed onto the retaining portion 141. Further, the retaining block 131 has a first side surface 1310, a second side surface 1311 disposed opposite the first side surface 1310, and a third side surface 1312 connected between the first side surface 1310 and the second side surface 1311. Thereby, the retaining portion 141 is limited by the second side surface 1311 of at least one retaining block 131 and can be movably fixed onto a predetermined flat surface. That is, the retaining portion 141 continues to contact the second side surface 1311 of the at least one retaining block 131 for rotation at a predetermined angle.

Figure 4:
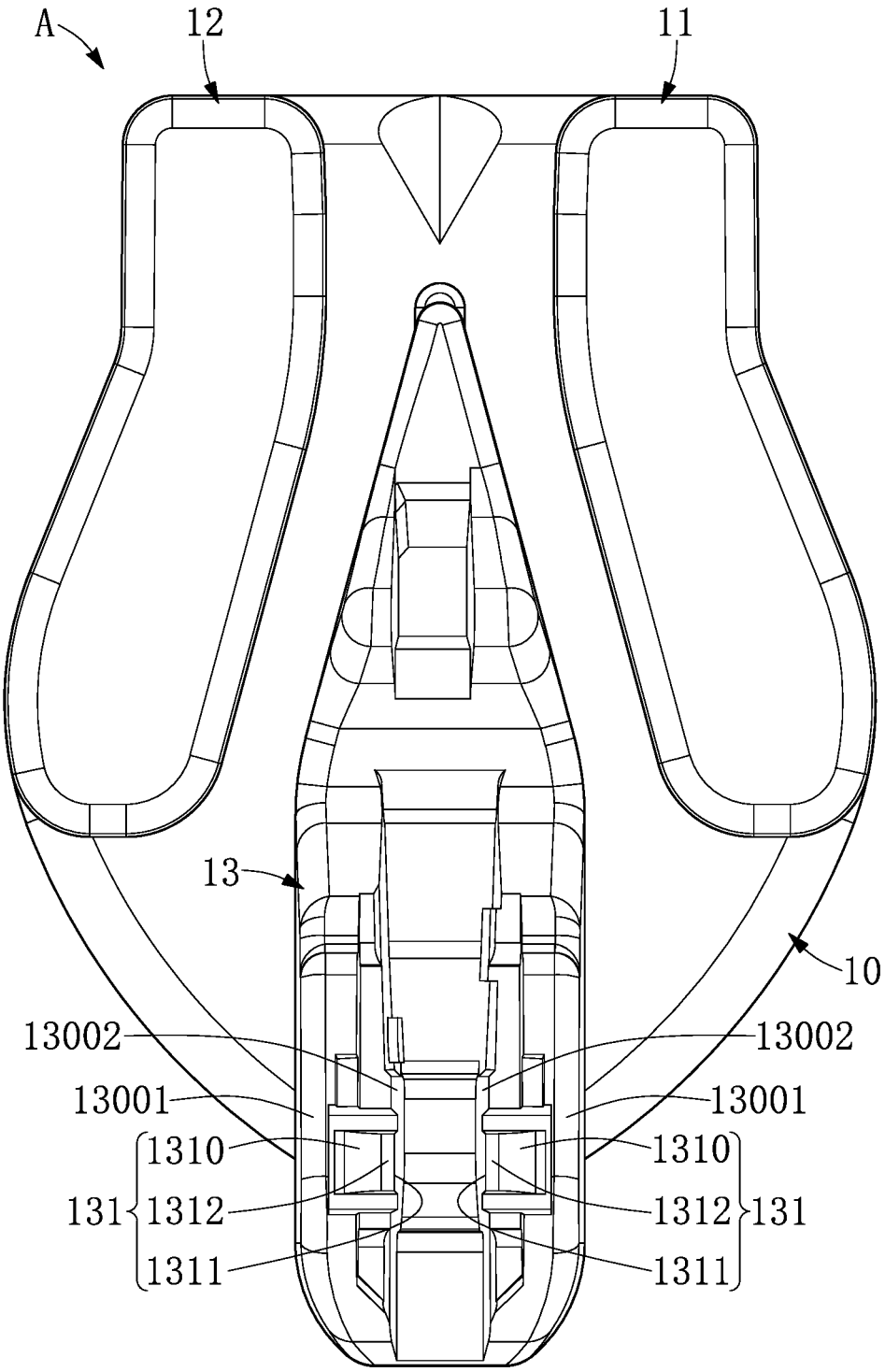
FIG. 4 is an exploded perspective schematic view of the sliding assembly (with a top of the seat portion not yet being riveted) according to the first embodiment of the present disclosure.
Figure 5:
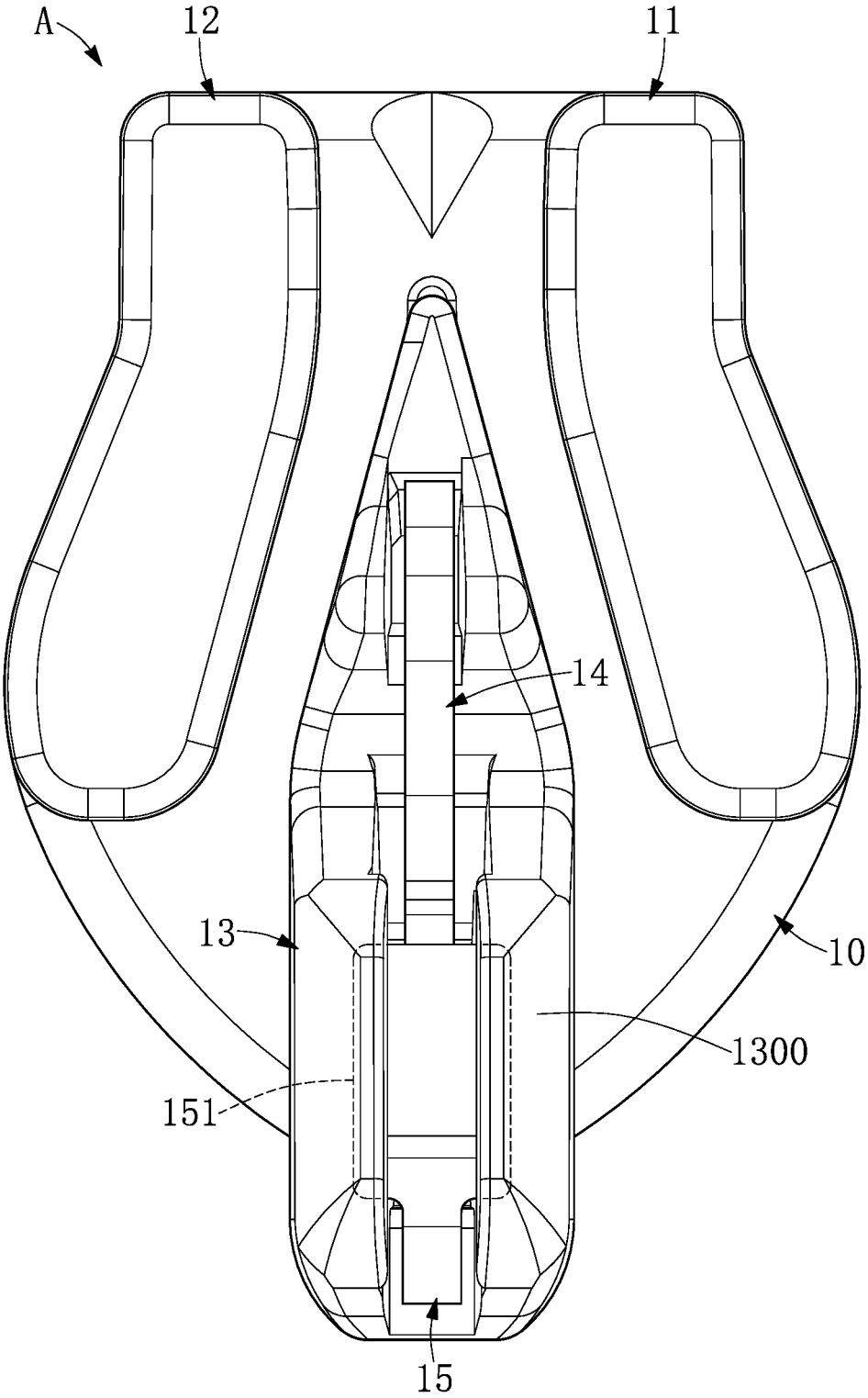
FIG. 5 is a top assembled schematic view of the sliding element according to the first embodiment of the present disclosure.

Furthermore, as shown in FIG. 1 and FIG. 4, the inner surface 13002 of the seat portion 13 is provided with another retaining block 131, and the two retaining blocks 131 correspond to each other to fix the opposite side ends of the retaining portion 141. In addition, as shown in FIG. 5, the seat portion 13 further has a retaining section 1300 for fixing the fixed portion 151 in place.

Figure 6:
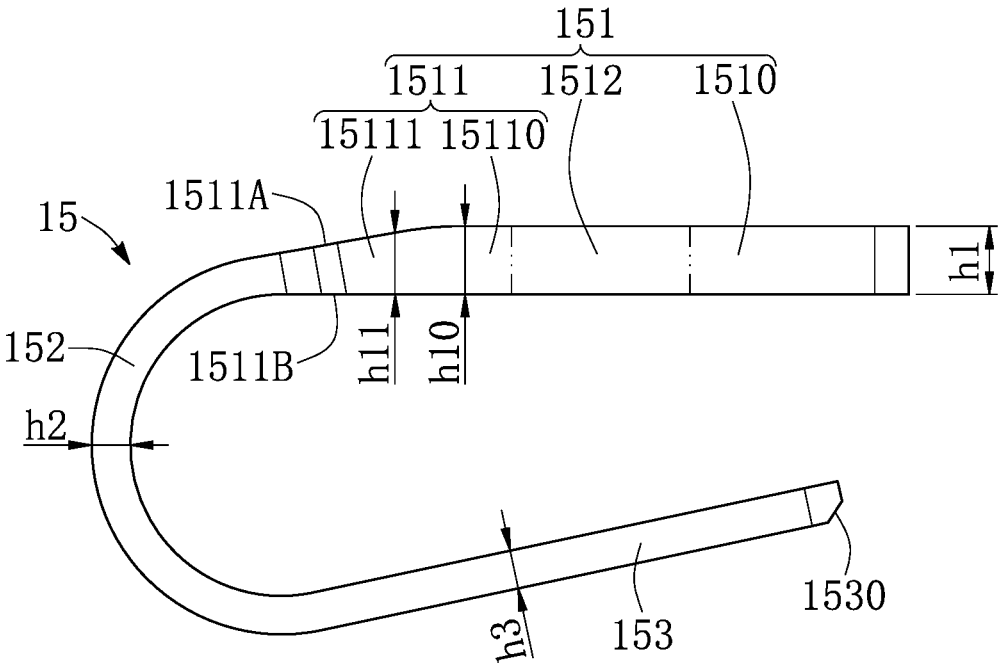
FIG. 6 is a lateral schematic view of an elastic member of the sliding assembly according to the first embodiment of the present disclosure.

It should be noted that, as shown in FIG. 6, a thickness h2 of the elastic portion 152 is smaller than a thickness h1 of the first fixing portion 151, so that an elastic coefficient and an elastic force provided by the elastic portion 152 can be increased. Therefore, the elastic portion 152 can avoid causing elastic fatigue and plastic deformation so as to increase the usage life of the elastic member 15. In addition, as shown in FIG. 6, FIG. 8, and FIG. 10, the abutting portion 153 has a slanted tip 1530 slidably contacting the locking hook 14 for increasing a contact area between the abutting portion 153 and the locking hook 14.

Figure 7:
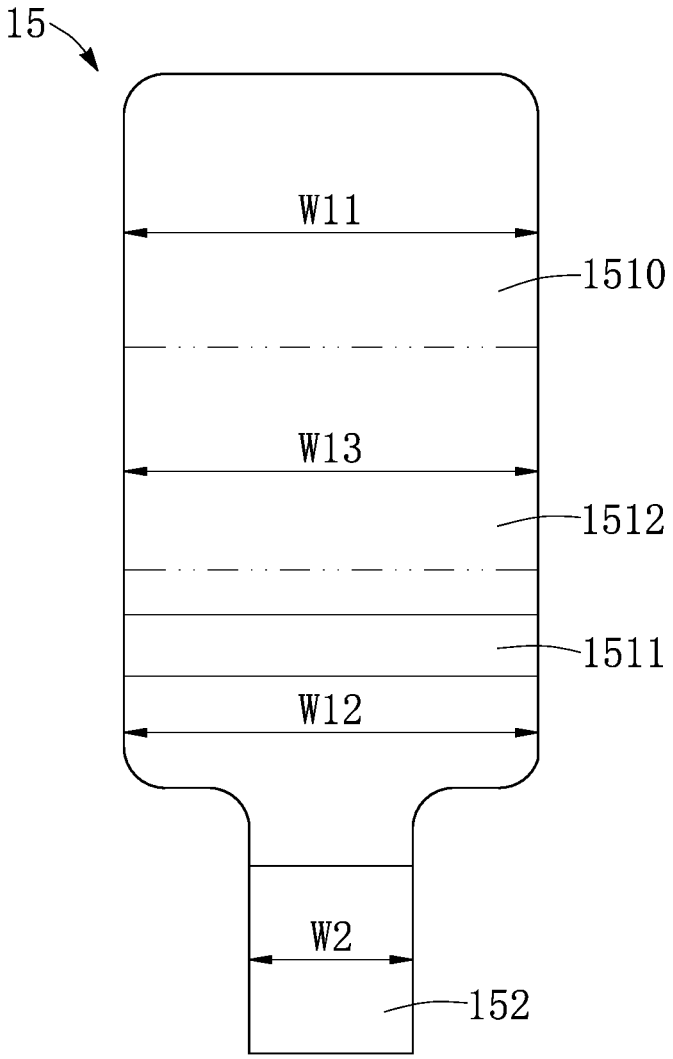
FIG. 7 is a top schematic view of an elastic member of the sliding assembly according to the first embodiment of the present disclosure.
Figure 8:
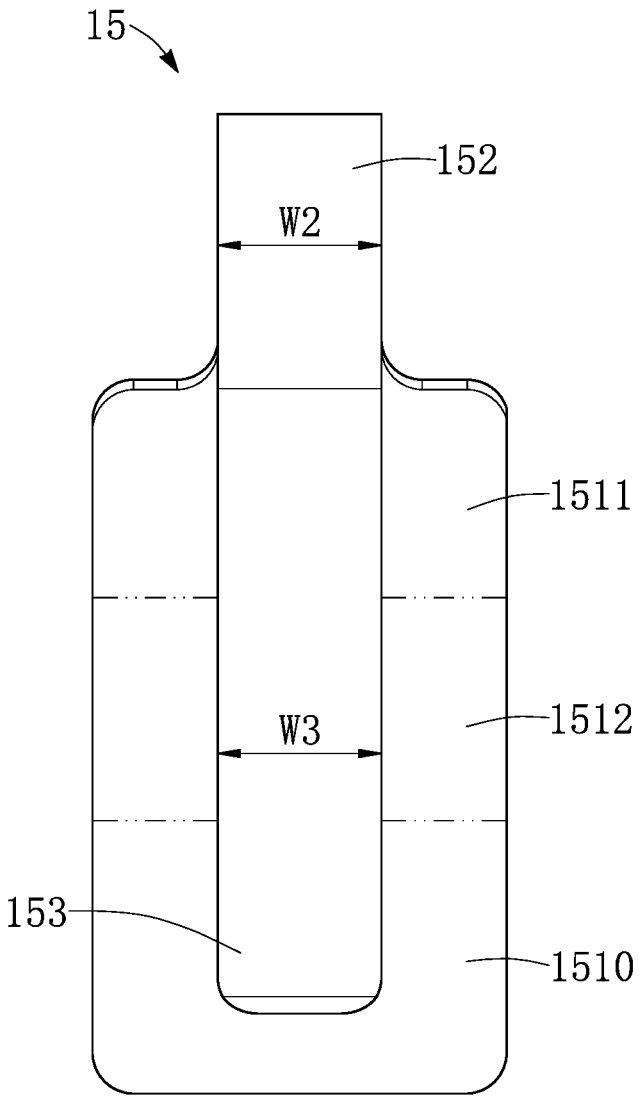
FIG. 8 is a bottom schematic view of an elastic member of the sliding assembly according to the first embodiment of the present disclosure.

More particularly, referring to FIG. 1, FIG. 7 and FIG. 8, the first fixing portion 151 has a front fixing section 1510, a rear fixing section 1511 connected to the elastic portion 152, and a middle fixing section 1512 connected between the front fixing section 1510 and the rear fixing section 1511. With regard to a width of the elastic member 15, as shown in FIG. 7, a width W11 of the front fixing section 1510, a width W12 of the rear fixing section 1511, and a width W13 of the middle fixing section 1512 are the same. As shown in FIG. 7 and FIG. 8, a width W2 of the elastic portion 152 is much smaller than the width W12 of the rear fixing section 1511, so that the elastic coefficient and the elastic force provided by the elastic portion 152 can be increased. Therefore, the elastic portion 152 can avoid causing elastic fatigue and plastic deformation so as to increase the usage life of the elastic member 15. In addition, as shown in FIG. 5, a width W3 of the abutting portion 153 is larger than or substantially equal to a width W2 of the elastic portion 152. In addition, the width W3 of the abutting portion 153 is equal to the width W2 of the elastic portion 152, but the present disclosure is not limited thereto; the width W3 may also be greater than the width W2, which may increase the contact area between the elastic member 15 and the locking hook 14.

Figure 12:
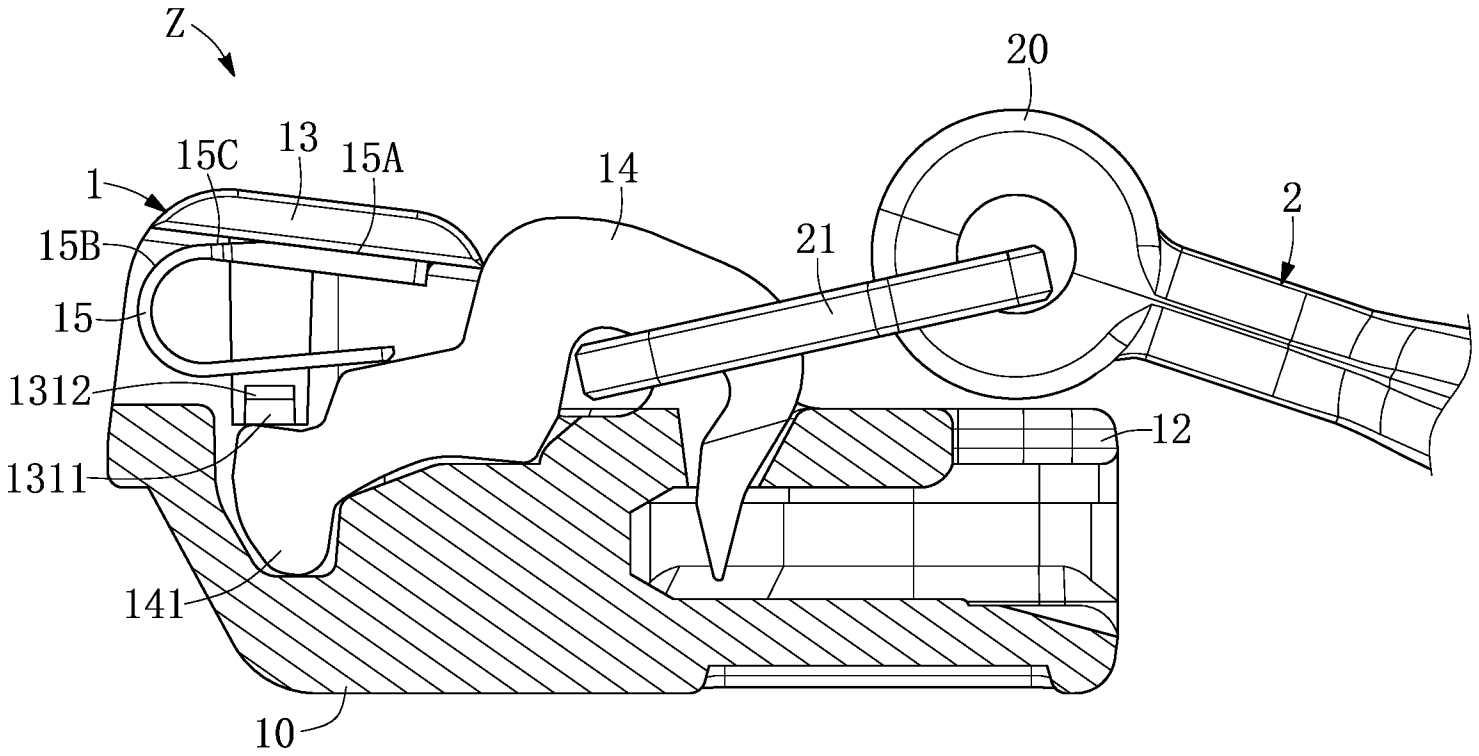
FIG. 12 is a cross-sectional view taken along the section line XII-XII of FIG. 11, before a locking hook of the zipper head assembly structure is upwardly pulled according to the first embodiment of the present disclosure.

More particularly, referring to FIG. 1 and FIG. 6, the rear fixing section 1511 has a first fixing section 15110 connected to the middle fixing section 1512 and a second fixing section 15111 connected between the first fixing section 15110 and the elastic portion 152. With regard to a thickness of the elastic member 15, as shown in FIG. 6, a thickness h2 of the elastic portion 152 is smaller than a thickness h10 of the first fixing section 15110 and the thickness h11 of the second fixing section 15111 of the rear fixing section 1511, and the thickness h11 of the second fixing section 15111 gradually decreases from the first fixing section 15110 to the elastic portion 152. That is, the thickness of the rear fixing section 1511 gradually decreases from the middle fixing section 1512 to the elastic portion 152 to form an inclined surface in the upper surface 1511A of the rear fixing section 1511. The inclined surface of the rear fixing section 1511 is connected to the upper surface of the elastic portion 152 to form a non-curved surface, and the bottom surface 1511B of the rear fixing section 1511 is connected to the bottom surface of the elastic portion 152 to form a continuous curved surface. Therefore, as shown in FIG. 12, an outer surface of the elastic member 15 has a flat surface 15A, a curved surface 15B, and an inclined surface 15C facing away from the locking hook 14, and the inclined surface is connected between the flat surface and the curved surface. In addition, the thickness h2 of the elastic portion 152 and the thickness h3 of the abutting portion 153 are substantially the same.

Figure 13:
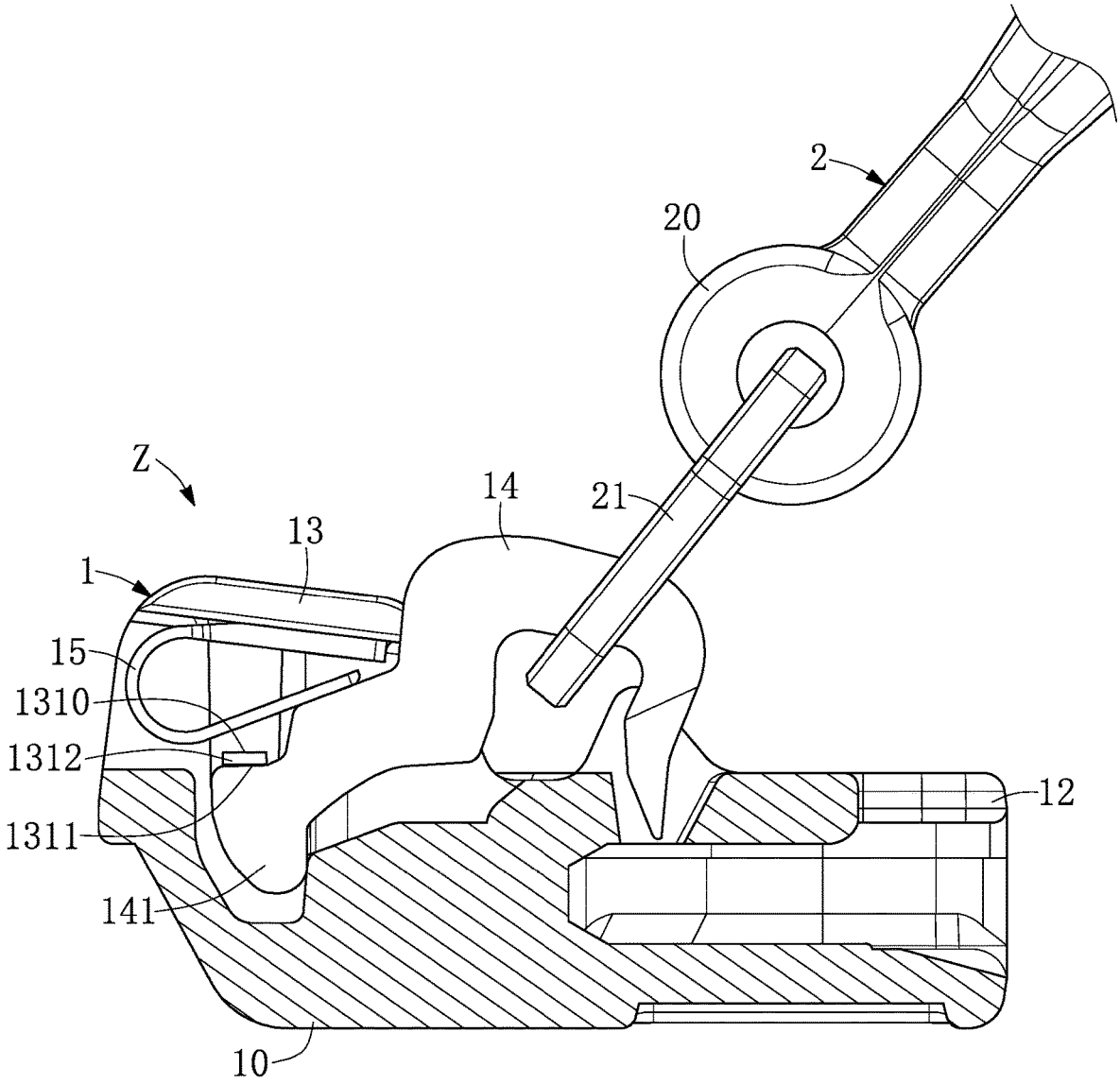
FIG. 13 is a cross-sectional view taken along the section line XII-XII of FIG. 11, after the locking hook of the zipper head assembly structure is upwardly pulled according to the first embodiment of the present disclosure.

More particularly, referring to FIG. 2, FIG. 3, FIG. 9 and FIG. 10, the seat portion 13 has a receiving groove 132 which is formed by the inside of the seat portion 13 being recessed toward the base portion 10. Therefore, the retaining portion 141 of the locking hook 14 is limited by the second side surface 1311 of the retaining block 131 in the receiving groove 132 and can be movably fixed onto a predetermined flat surface, so that the locking hook 14 moves with the retaining portion 141 serving as a rotational axis to move up (as shown in FIG. 13) or down (as shown in FIG. 12).

Referring to FIG. 1 and FIG. 11 to FIG. 13, the present disclosure provides a zipper head assembly structure Z, including a sliding member 1 and a pull member 2 (or a pull tab). The sliding member 1 includes a base portion 10, a first lateral wall portion 11, a second lateral wall portion 12, a seat portion 13, a locking hook 14, and an elastic member 15. The first lateral wall portion 11 and the second lateral wall portion 12 are respectively extend upward from opposite side ends of the base portion 10, and the first lateral wall portion 11 and the second lateral wall portion 12 correspond to each other and are connected to a front end 101 of the base portion 10. In addition, the seat portion 13 is disposed on the base portion 10 and connected to a rear end 102 of the base portion 10, and the seat portion 13 has a through positioning opening 130 between the first lateral wall portion 11 and the second lateral wall portion 12. In addition, the elastic member 15 is disposed on the seat portion 13 to elastically abut against the locking hook 14, and the elastic member 15 has a fixed portion 151 fixed onto the seat portion 13, an elastic portion 152 extending from the fixed portion 151, and an abutting portion 153 extending from the elastic portion 152 and abutting against the locking hook 14. Further, the locking hook 14 is movably disposed on the seat portion 13 and movably contacts the abutting portion 153 of the elastic member 15, and one end of the locking hook 14 has a positioning portion 140 passing through the through positioning opening 130. In addition, the pull member 2 can movably cooperate with the locking hook 14. For example, one of the end portions 20 of the pull member 2 has a movable piece 21 that movably cooperates with the locking hook 14.

In conclusion, one of the beneficial effects of the present disclosure is that, by the technical features of "the inner surface 13002 of the seat portion 13 being provided with at least one retaining block 131," "another end of the locking hook 14 having the retaining portion 131, and the at least one retaining block 131 fixes the retaining portion in place 141 in place" and "the elastic member 15 being disposed in the seat portion 13 and located between the locking hook 14," the locking hook 14 is movably disposed on the seat portion 13 and movably contacts the elastic member 15.

Second Embodiment

Referring to FIG. 14 to FIG. 25, a second embodiment of the present disclosure provides a sliding member 1 (such as a sliding head or a slide fastener head), and the sliding member 1 includes a base portion 10, a first lateral wall portion 11, a second lateral wall portion 12, a seat portion 13, a locking hook 14, and an elastic member 15. The base portion 10, the first lateral wall portion 11, the second lateral wall portion 12 and the seat portion 13 cooperate with each other to form a sliding member A.

Figure 14:
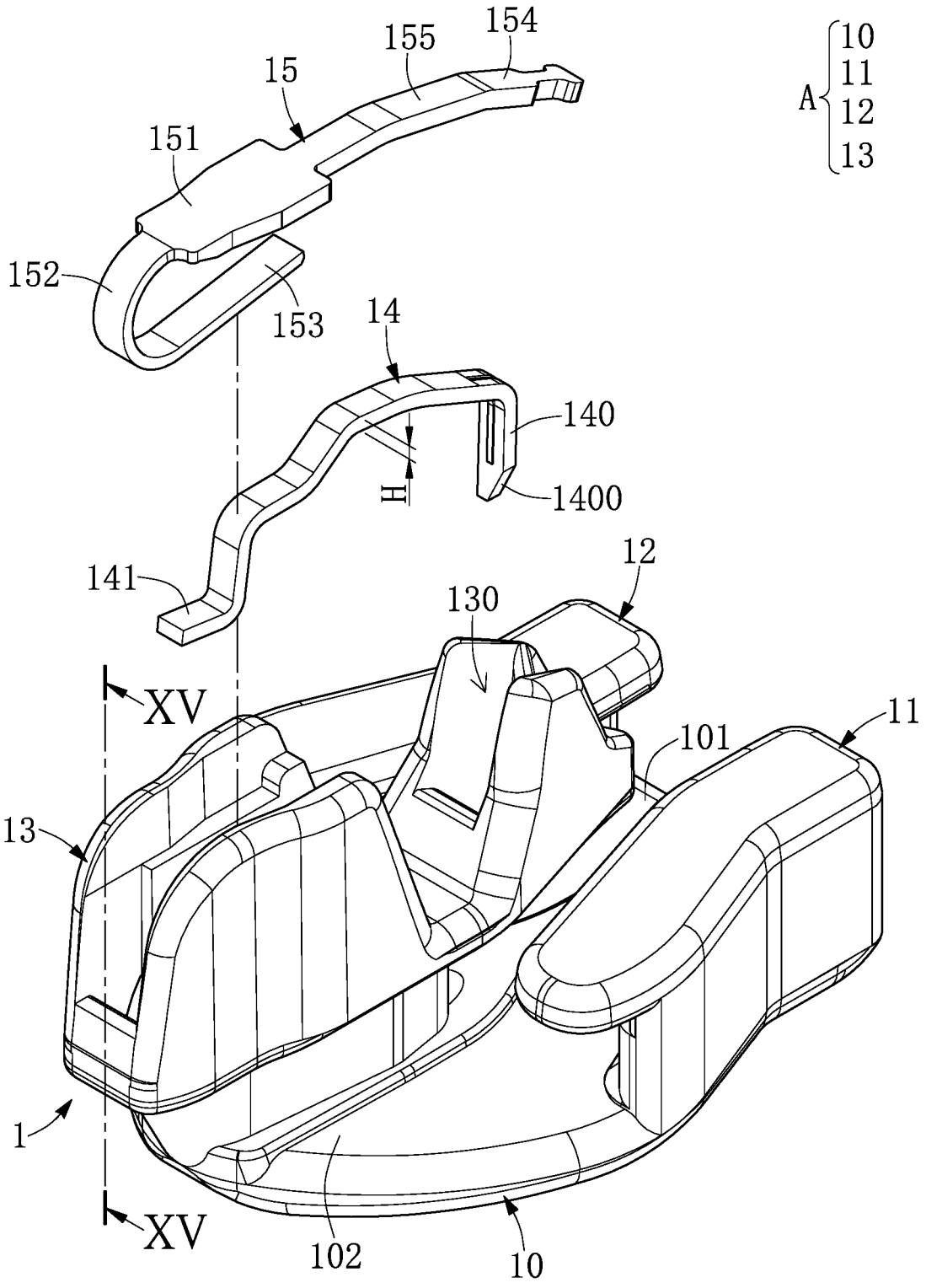
FIG. 14 is an exploded perspective schematic view of a sliding assembly (with an elastic member not yet being riveted and retained by a seat portion) according to a second embodiment of the present disclosure.
Figure 21:
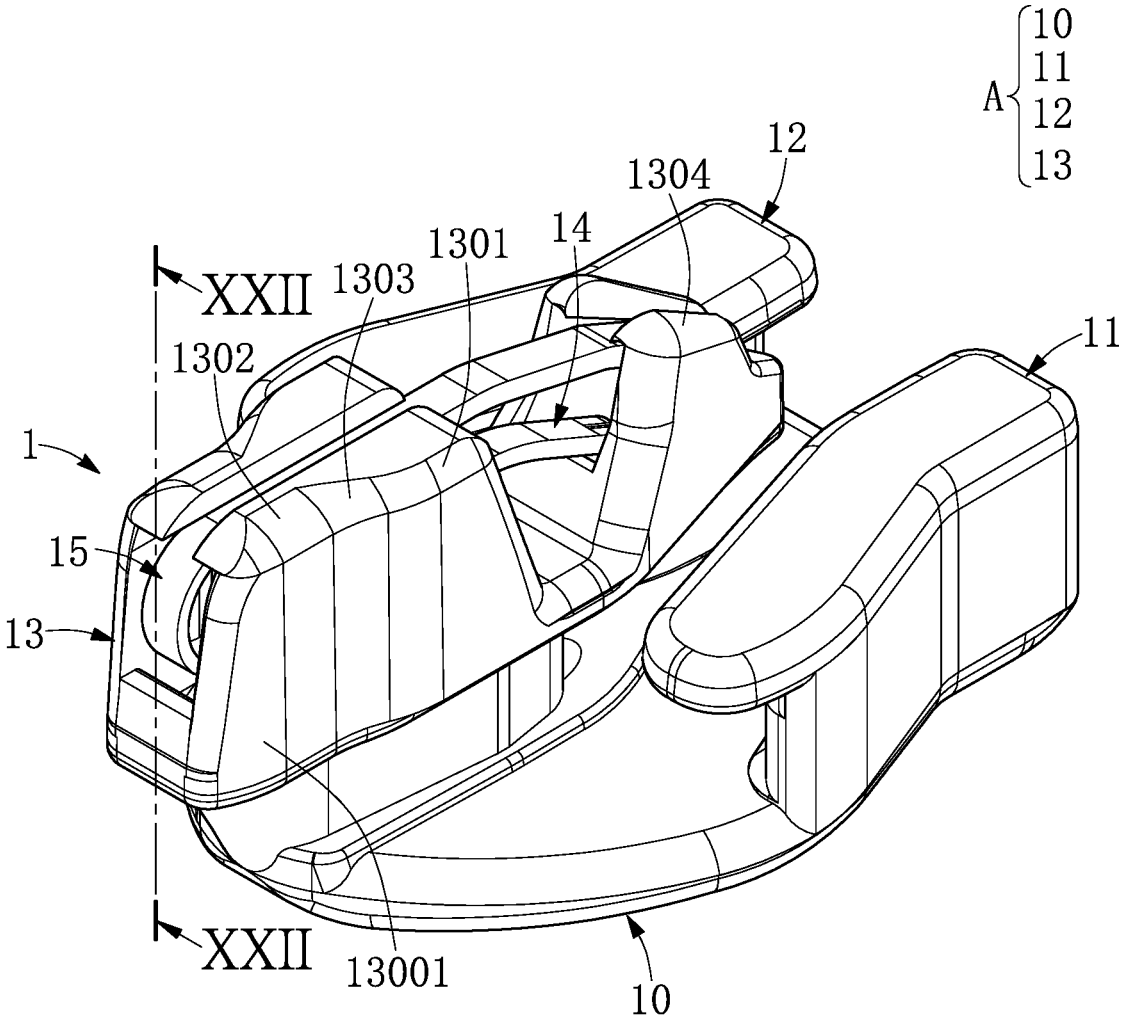
FIG. 21 is an assembled perspective schematic view of the sliding assembly (with the elastic member being riveted and retained by the top of the seat portion) according to the second embodiment of the present disclosure.
Figure 22:
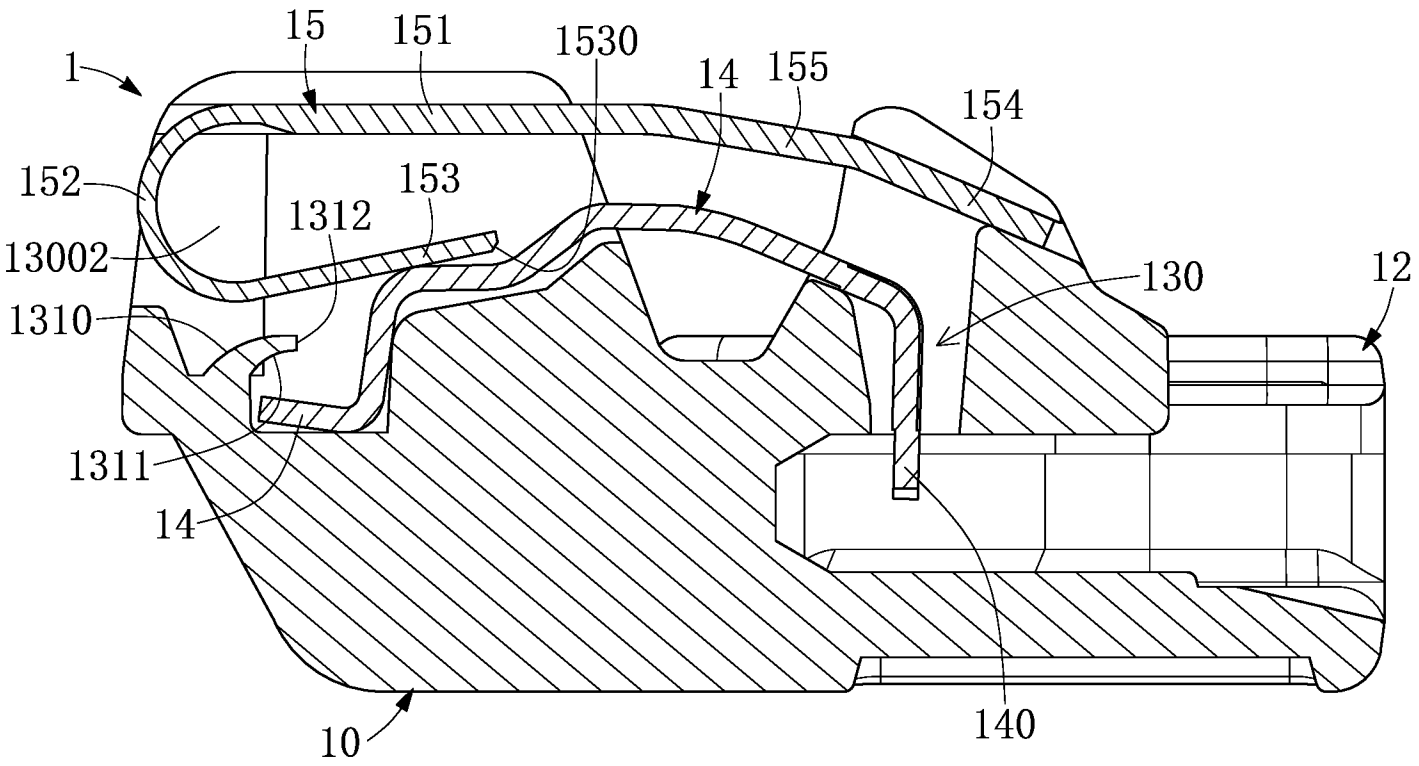
FIG. 22 is a cross-sectional view taken along the section line XXII-XXII of FIG. 21.
Figure 23:
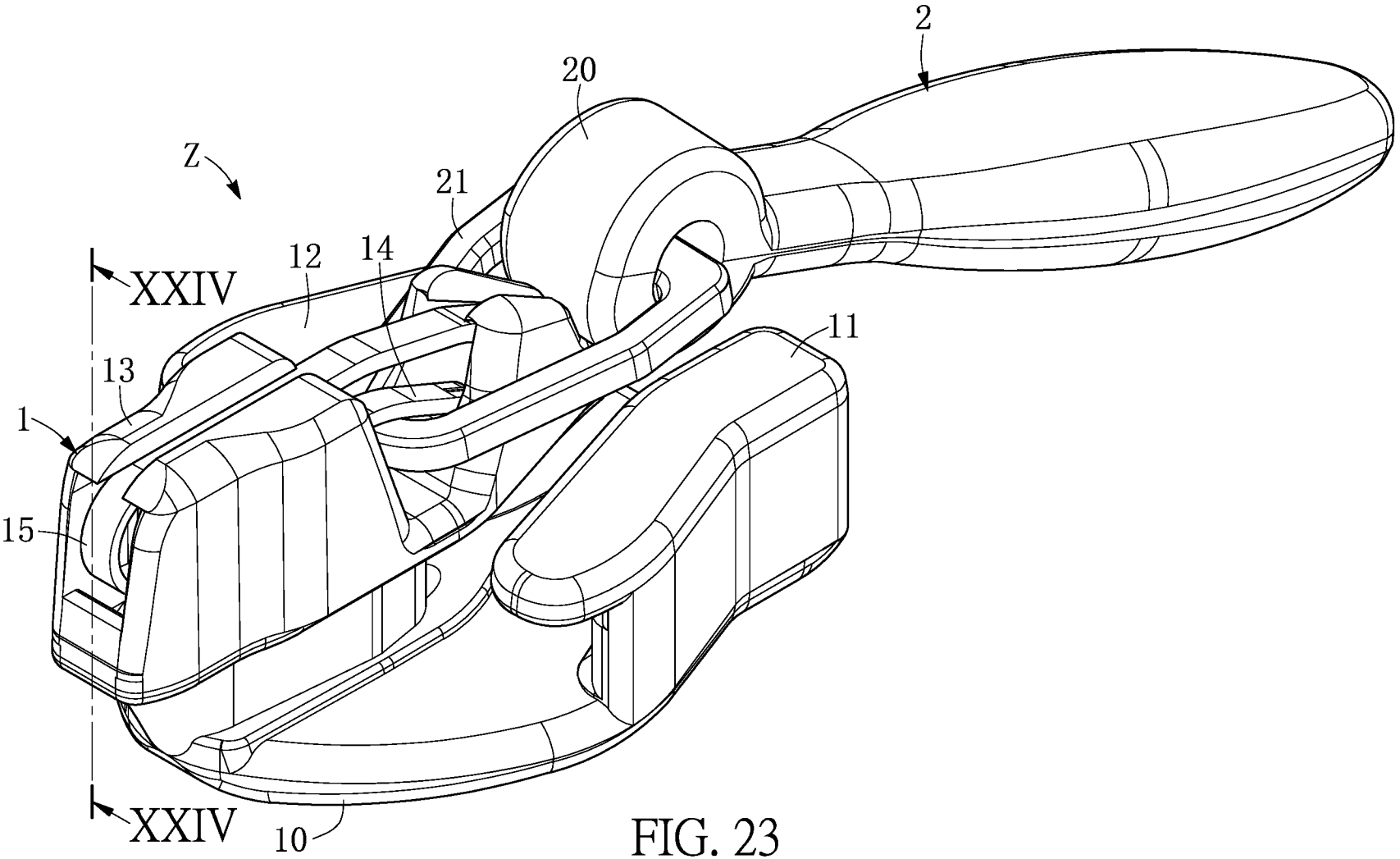
FIG. 23 is a perspective schematic view of a zipper head assembly structure according to the second embodiment of the present disclosure.

Referring to FIG. 14, FIG. 21 and FIG. 22, the first lateral wall portion 11 and the second lateral wall portion 12 respectively extend upward from opposite side ends of the base portion 10, and the first lateral wall portion 11 and the second lateral wall portion 12 correspond to each other and are connected to a front end 101 of the base portion 10. In addition, the base seat 13 is disposed on the base portion 10 and connected to a rear end 102 of the base portion 10, and the base seat 13 includes a through positioning opening 130 between the first lateral wall portion 11 and the second lateral wall portion 12. Further, the elastic member 15 is disposed on the seat portion 13 to elastically abut against the locking hook 14, and the elastic member 15 has a fixed portion 151 fixed onto the seat portion 13, an elastic portion 152 extending from the fixed portion 151, and an abutting portion 153 extending from the elastic portion 152 and abutting against the locking hook 14. Furthermore, the locking hook 14 is movably disposed on the seat portion 13 and movably contacts the abutting portion 153 of the elastic member 15, one end of the movable retaining element 14 includes a positioning portion 140 that passes through the through positioning opening 130, and another end of the locking hook 14 has a retaining portion 141. It is worth mentioning that the locking hook 14 has an even thickness H, and one side of the positioning portion 140 of the locking hook 14 has a trimmed edge 1400 for evading contact.

Figure 15:
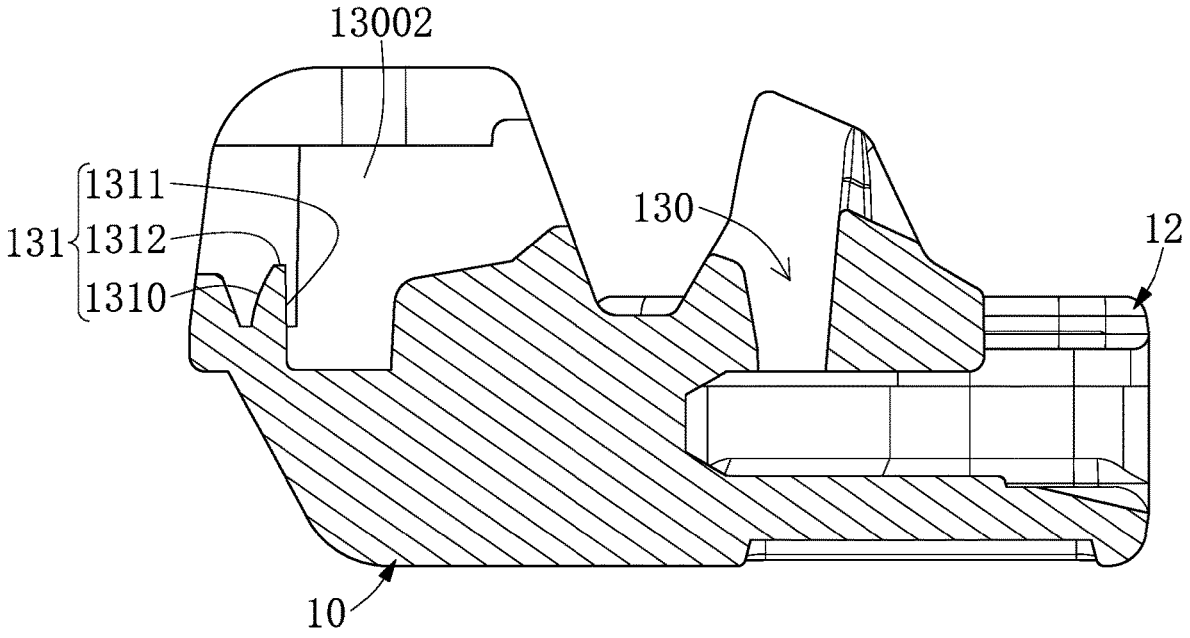
FIG. 15 is a cross-sectional view taken along the section line XV-XV of FIG. 14.

It should be noted that, as shown in FIG. 14 to FIG. 16 and FIG. 22, an inner surface 13002 of the seat portion 13 is provided with at least one retaining block 131, the retaining block 131 extends outward from the inside of the seat portion 13, and the retaining block 131 is parallel to the inner surface 13002 of the seat portion 13 (as shown in FIG. 15). In addition, the retaining block 131 may be curved in an arc relative to the inner portion of the seat portion 13 (as shown in FIG. 22), and at least one retaining block 131 is fixed onto the retaining portion 141, that is, at least one retaining block 131 and the retaining portion 141 extend in opposite directions, and at least one retaining block 131 contacts and abuts the rearmost end of the retaining portion 141. Further, the retaining block 131 has a first side surface 1310, a second side surface 1311 disposed opposite the first side surface 1310, and a third side surface 1312 connected between the first side surface 1310 and the second side surface 1311. Thereby, the retaining portion 141 is limited by the second side surface 1311 of at least one retaining block 131 and can be movably fixed onto a predetermined flat surface. That is, the retaining portion 141 continues to contact the second side surface 1311 of the at least one retaining block 131 for a rotation at a predetermined angle.

Figure 18:
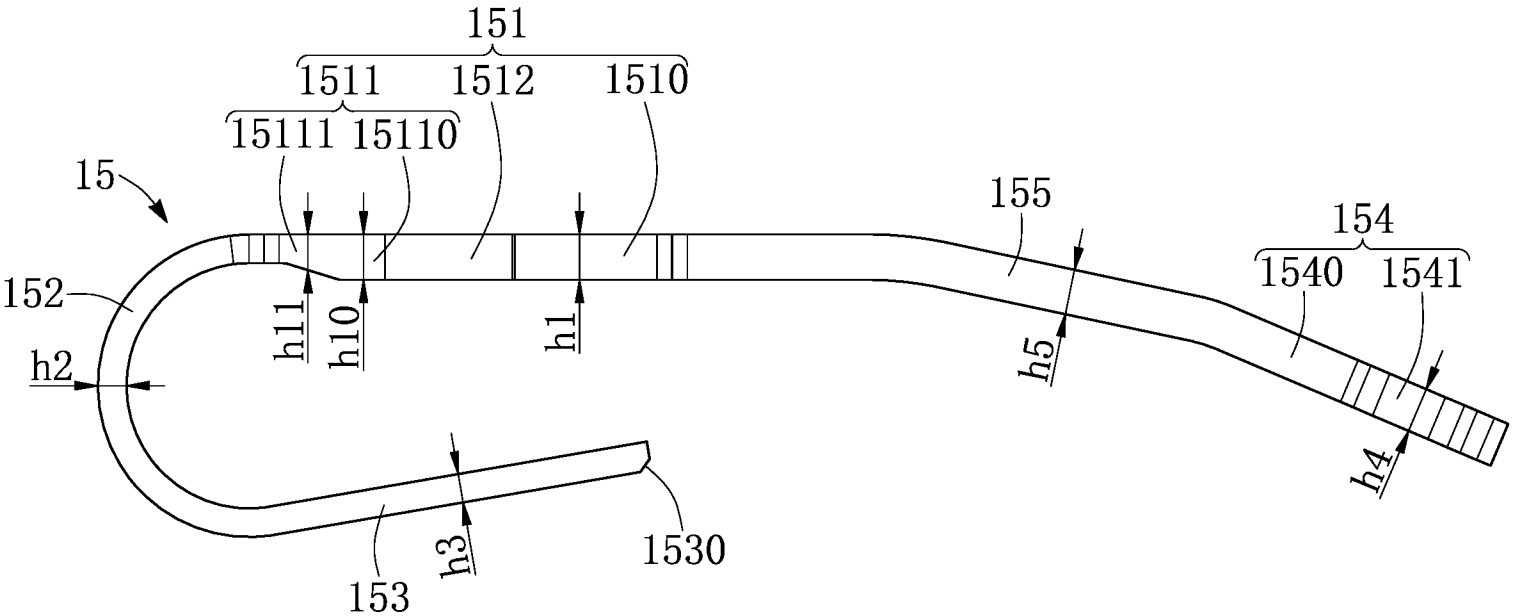
FIG. 18 is a lateral schematic view of an elastic member of the sliding assembly according to the second embodiment of the present disclosure.

It should be noted that, as shown in FIG. 18, a thickness h2 of the elastic portion 152 is smaller than a thickness h1 of the first fixing portion 151, so that an elastic coefficient and an elastic force provided by the elastic portion 152 can be increased. Therefore, the elastic portion 152 can avoid causing elastic fatigue and plastic deformation so as to increase the usage life of the elastic member 15. In addition, the thickness h1 of the first fixing portion 151, the thickness h4 of the second fixing portion 154, and the thickness h5 of the exposed portion 155 are substantially the same, and the abutting portion 153 has a slanted tip 1530 at one end.

Figure 16:
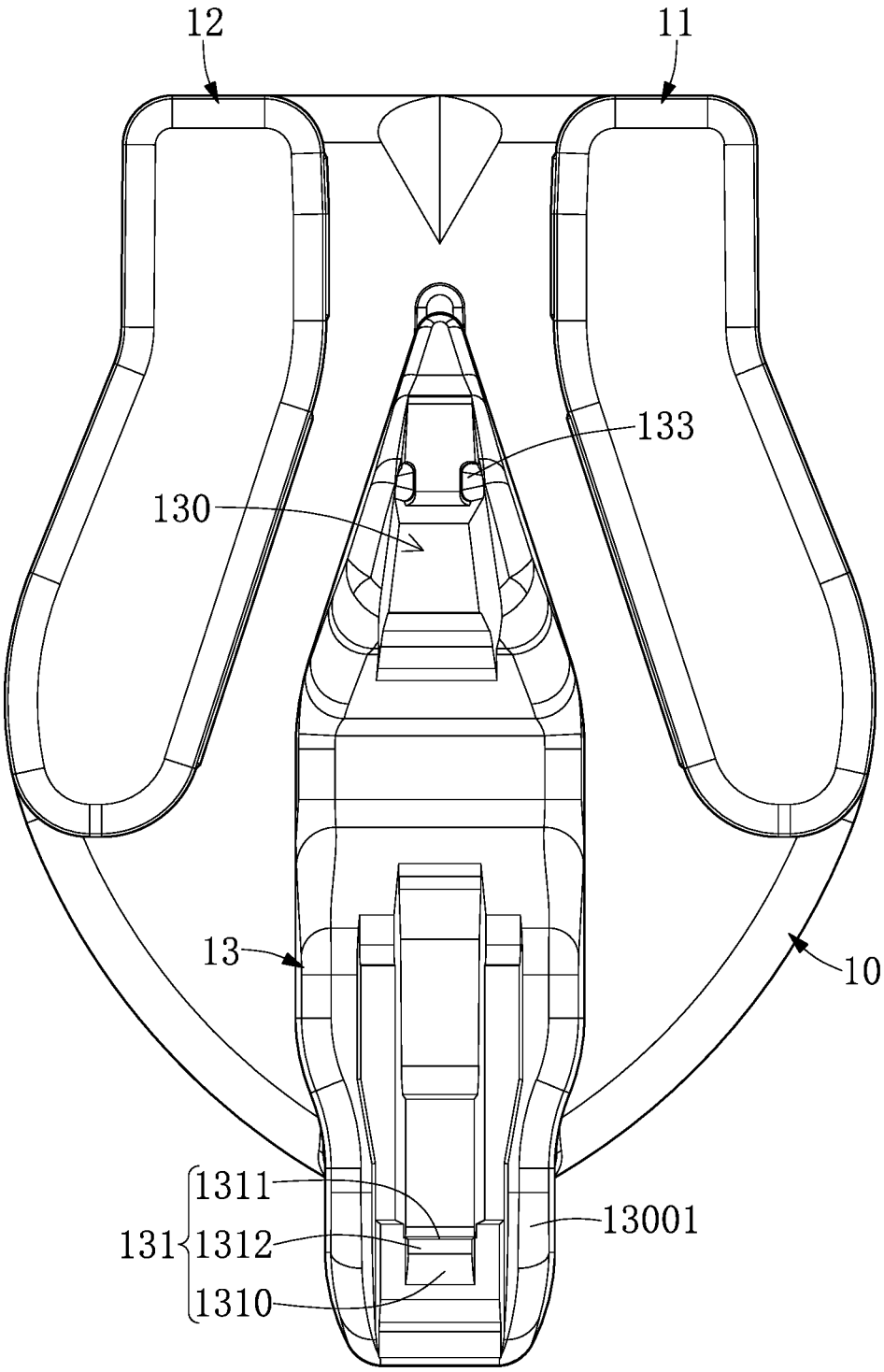
FIG. 16 is an exploded perspective schematic view of the sliding assembly (with a top of the seat portion not yet being riveted) according to the second embodiment of the present disclosure.
Figure 19:
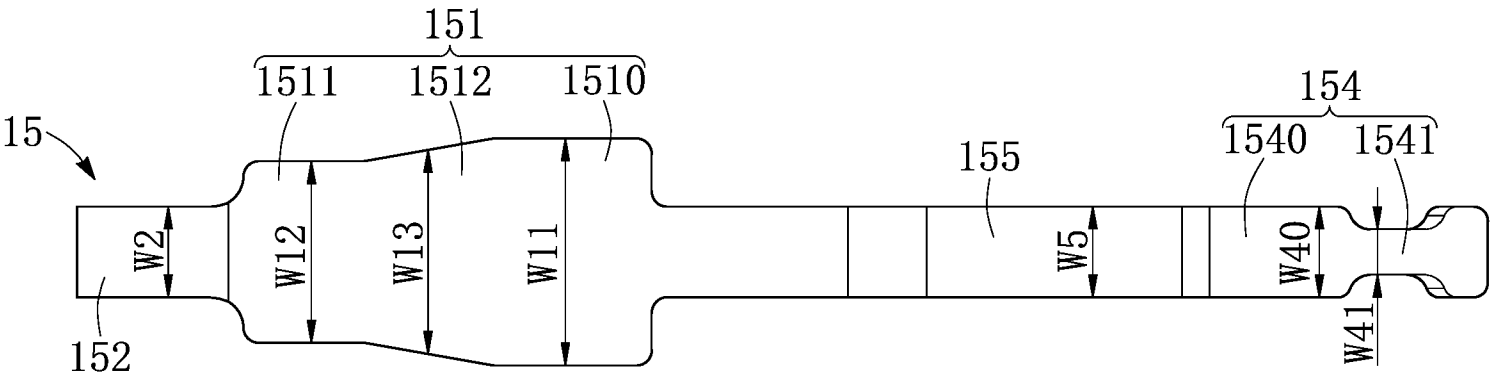
FIG. 19 is a top schematic view of an elastic member of the sliding assembly according to the second embodiment of the present disclosure.
Figure 20:
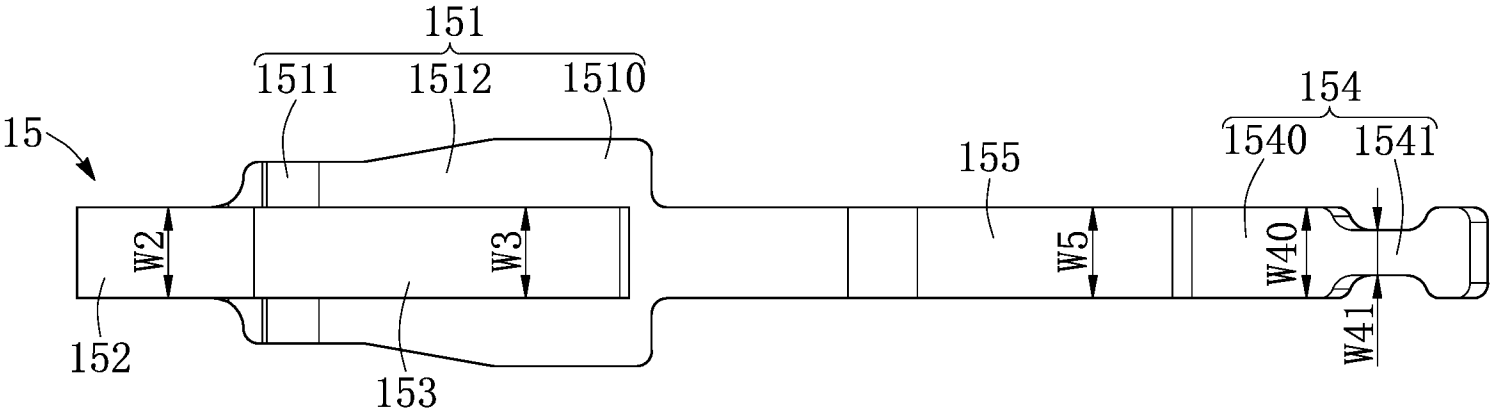
FIG. 20 is a bottom schematic view of an elastic member of the sliding assembly according to the second embodiment of the present disclosure.

More particularly, referring to FIG. 14, FIG. 19 and FIG. 20, the first fixing portion 151 has a front fixing section 1510, a rear fixing section 1511 connected to the elastic portion 152, and a middle fixing section 1512 connected between the front fixing section 1510 and the rear fixing section 1511. With regard to a width of the elastic member 15, as shown in FIG. 19, a width W12 of the rear fixing section 1511 is smaller than a width W11 of the front fixing section 1510, and a width W13 of the middle fixing section 1512 are the same. As shown in FIG. 7 and FIG. 8, a width W2 of the elastic portion 152 is much smaller than the width W12 of the rear fixing section 1511, and a width W13 of the middle fixing section 1512 gradually decreases from the front fixing section 1510 to the rear fixing section 1511. The width W2 of the elastic portion 152 is much smaller than the width W12 of the rear fixing section 1511, so that the elastic coefficient and the elastic force provided by the elastic portion 152 can be increased. Therefore, the elastic portion 152 can avoid causing elastic fatigue and plastic deformation so as to increase the usage life of the elastic member 15. In addition, as shown in FIG. 20, a width W3 of the abutting portion 153 is larger than or substantially equal to a width W2 of the elastic portion 152. If the width W3 of the abutting portion 153 is greater than the width W2 of the elastic portion 152, the contact area between the elastic member 15 and the locking hook 14 increases. It is worth mentioning that, as shown in FIG. 19 and FIG. 20, the width W3 of the abutting portion 153 and the width W5 of the exposed portion 155 are substantially the same. The second fixing portion 154 has a retaining body 1540 connected to the exposed portion 155 and a concave body 1541 connected to the retaining body 1540. The width W40 of the retaining body 1540 and the width W5 of the exposed portion 155 are substantially the same, and the width W41 of the concave body 1541 is smaller than the width W40 of the retaining body 1540. Further, as shown in FIG. 16, the seat portion 13 has a plurality of limiting portions 133 which are formed to protrude outward from the inner wall of the seat portion 13 and are located in the through positioning opening 130. Therefore, the retaining body 1540 of the elastic member 15 cooperated with the plurality of limiting portions 133 so that the retaining body 1540 is limited in the through positioning opening 130.

More particularly, referring to FIG. 14 and FIG. 18, the rear fixing section 1511 has a first fixing section 15110 connected to the middle fixing section 1512 and a second fixing section 15111 connected between the first fixing section 15110 and the elastic portion 152. With regard to a thickness of the elastic member 15, as shown in FIG. 18, a thickness h2 of the elastic portion 152 is smaller than a thickness h10 of the first fixing section 15110 and the thickness h11 of the second fixing section 15111 of the rear fixing section 1511, and the thickness h11 of the second fixing section 15111 gradually decreases from the first fixing section 15110 to the elastic portion 152. In addition, the thickness h2 of the elastic portion 152 and the thickness h3 of the abutting portion 153 are substantially the same.

Figure 17:
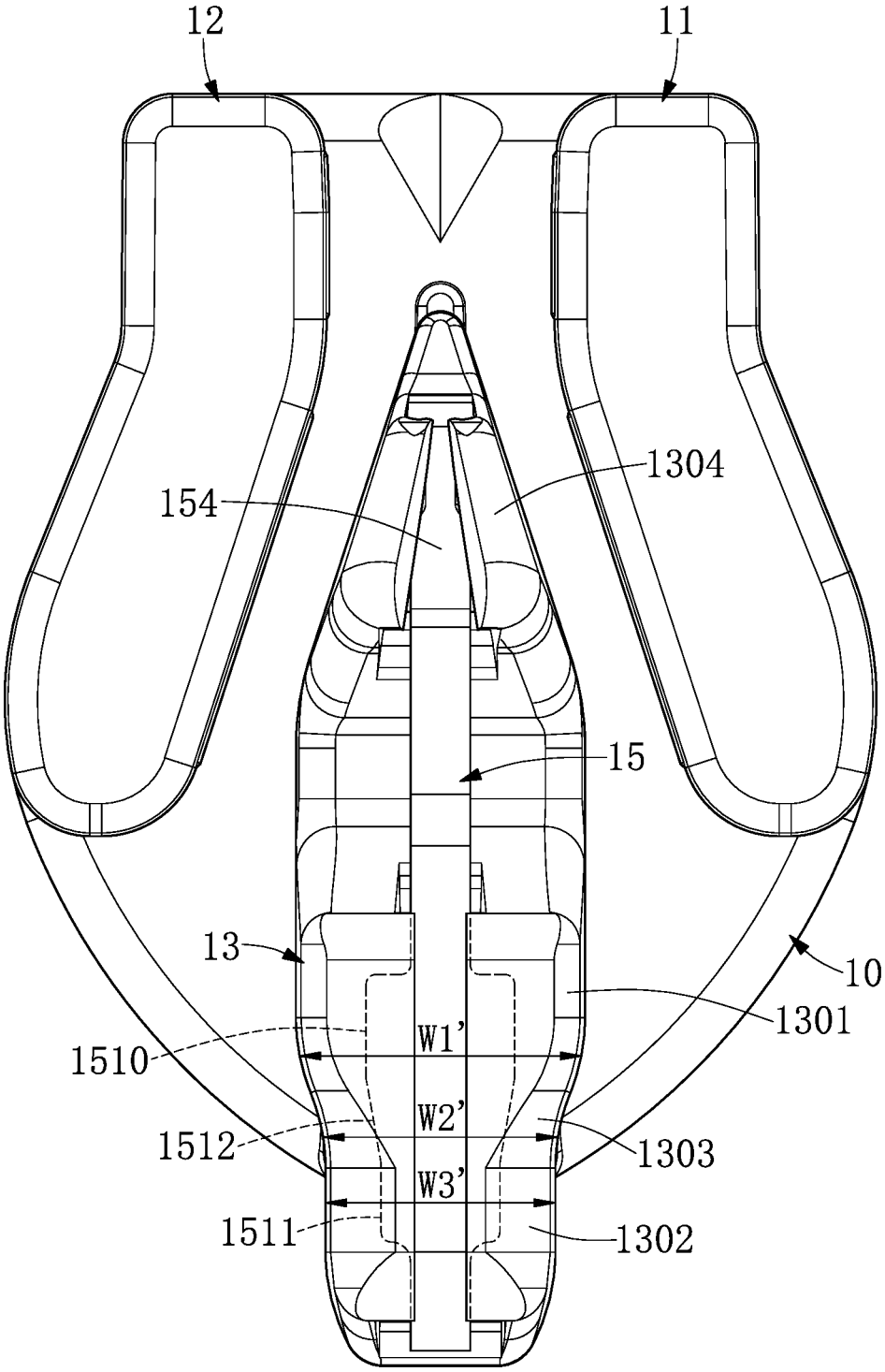
FIG. 17 is an assembled schematic view of the sliding assembly (the elastic member has been riveted and retained by the top of a seat portion) according to the first embodiment of the present disclosure.

More particularly, referring to FIG. 14, FIG. 17 and FIG. 21, the seat portion 13 has a front retaining section 1301 for fixing the front fixing section 1510, a rear retaining section 1302 for fixing the rear fixing section 1511, and a middle retaining section 1303 connected between the front retaining section 1301 and the rear retaining section 1302 for fixing the middle fixing section 1512. In addition, as shown in FIG. 17, a width W2' of the rear retaining section 1302 is smaller than a width W1' of the front retaining section 1301, and a width W3' of the middle retaining section 1303 gradually decreases from the front retaining section 1301 to the rear retaining section 1302. Since both of the width W3' of the middle retaining section 1303 and the width W2' of the rear retaining section 1302 are smaller than the width W1' of the front retaining section 1301, friction between the seat portion 13 and the clothing can be effectively reduced, thereby increasing a smoothness of sliding between the sliding member 1 and clothing. It is worth mentioning that, as shown in FIG. 17 and FIG. 21, the seat portion 13 has an auxiliary retaining section 1304 separated from the front retaining section 1301 for fixing the second fixing portion 154.

Figure 24:
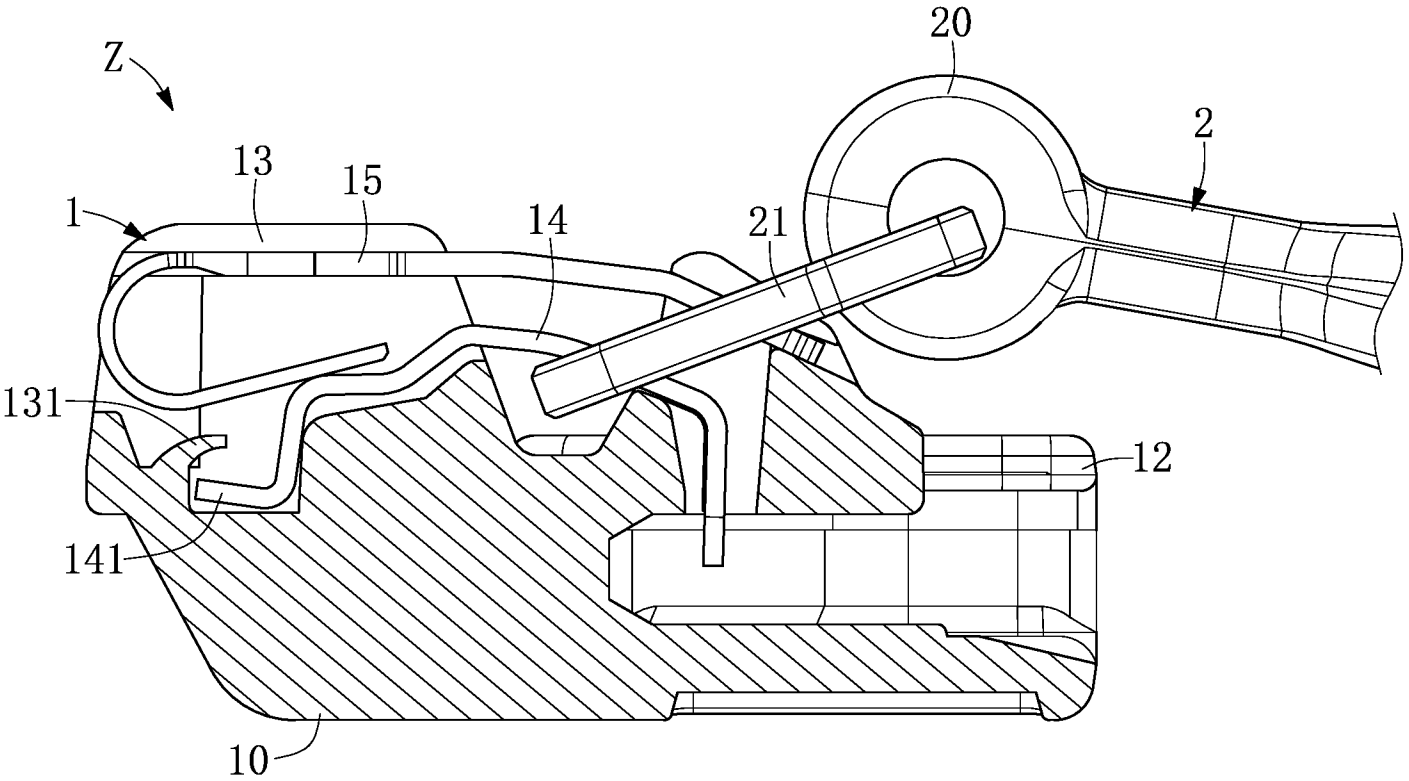
FIG. 24 is a cross-sectional view taken along the section line XXIV-XXIV of FIG. 23, before a locking hook of the zipper head assembly structure is upwardly pulled according to the second embodiment of the present disclosure.
Figure 25:
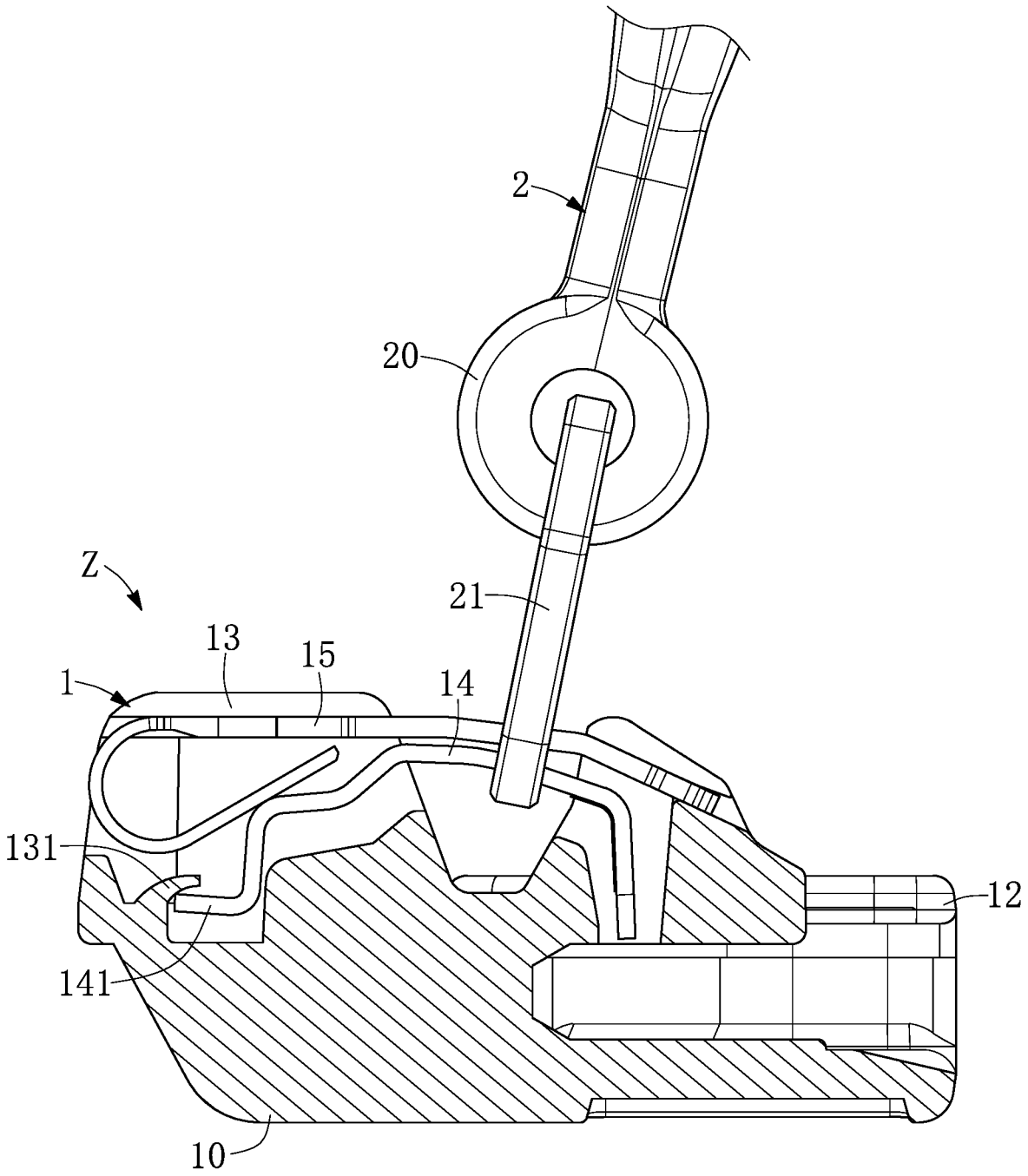
FIG. 25 is a cross-sectional view taken along the section line XXIV-XXIV of FIG. 23, after the locking hook of the zipper head assembly structure is upwardly pulled according to the second embodiment of the present disclosure.

Further, the retaining portion 141 of the locking hook 14 is limited by the second side surface 1311 of the retaining block 131 in the receiving groove 132 and can be movably fixed onto a predetermined flat surface, so that the locking hook 14 moves with the retaining portion 141 serving as a rotational axis to move up (as shown in FIG. 25) or down (as shown in FIG. 24).

Referring to FIG. 14 and FIG. 23 to FIG. 25, the present disclosure provides a zipper head assembly structure Z, including a sliding member 1 and a pull member 2 (or a pull tab). The sliding member 1 includes a base portion 10, a first lateral wall portion 11, a second lateral wall portion 12, a seat portion 13, a locking hook 14, and an elastic member 15. The first lateral wall portion 11 and the second lateral wall portion 12 respectively extend upward from opposite side ends of the base portion 10, and the first lateral wall portion 11 and the second lateral wall portion 12 correspond to each other and are connected to a front end 101 of the base portion 10. In addition, the seat portion 13 is disposed on the base portion 10 and connected to a rear end 102 of the base portion 10, and the seat portion 13 has a through positioning opening 130 between the first lateral wall portion 11 and the second lateral wall portion 12. In addition, the elastic member 15 is disposed on the seat portion 13 to elastically abut against the locking hook 14, and the elastic member 15 has a fixed portion 151 fixed onto the seat portion 13, a second fixing portion 154 fixed to the seat portion 13, an exposed portion 155 connected between the first fixing portion 151 and the second fixing portion 154 and exposed outside the seat portion 13, an elastic portion 152 extending from the first fixing portion 151, and an abutting portion 153 extending from the elastic portion 152 and abutting against the locking hook 14. Further, the locking hook 14 is movably disposed on the seat portion 13 and movably contacts the abutting portion 153 of the elastic member 15, and one end of the locking hook 14 has a positioning portion 140 passing through the through positioning opening 130. In addition, the pull member 2 can movably cooperate with the locking hook 14. For example, one of the end portions 20 of the pull member 2 has a movable piece 21 that movably cooperate with the locking hook 14.

As mentioned above, the zipper head assembly structure Z provided by the present disclosure has the technical features of "the first fixing portion 151 and the second fixing portion 154 of the elastic member 15 being fixed onto the seat portion 13" so as to improve a bonding force (or bonding strength) between the elastic member 15 and the seat portion 13, thereby preventing the elastic member 15 from being detached from the seat portion 13, that is, it can prevent the pull member 2 from being detached from the sliding member 1.

Furthermore, the zipper head assembly structure Z and the elastic member 15 provided by the present disclosure has the technical features of "the elastic member 15 having a fixed portion 151 fixed onto the seat portion 13, a second fixing portion 154 fixed to the seat portion 13, an exposed portion 155 connected between the first fixing portion 151 and the second fixing portion 154 and exposed outside the seat portion 13, an elastic portion 152 extending from the first fixing portion 151, and an abutting portion 153 extending from the elastic portion 152 and abutting against the locking hook 14" and "the thickness h2 of the elastic portion 152 may be smaller than the thickness h1 of the first fixing portion 151" so as to increase the elastic coefficient and elastic force that the elastic portion 152 can provide, thereby avoiding elastic fatigue or plastic deformation of the elastic portion 152, and effectively improving the usage life of the elastic member 15.

In conclusion, one of the beneficial effects of the present disclosure is that, by the technical features of "the inner surface 13002 of the seat portion 13 being provided with at least one retaining block 131" and "another end of the locking hook 14 having the retaining portion 141, and the at least one retaining block 131 fixes the retaining portion in place 141 in place," the retaining portion 141 is limited by the at least one retaining block 131 and can be movably fixed onto a predetermined flat surface.

The foregoing description of the exemplary embodiments of the disclosure has been presented only for the purposes of illustration and description and is not intended to be exhaustive or to limit the disclosure to the precise forms disclosed. Many modifications and variations are possible in light of the above teaching.

The embodiments were chosen and described in order to explain the principles of the disclosure and their practical application so as to enable others skilled in the art to utilize the disclosure and various embodiments and with various modifications as are suited to the particular use contemplated. Alternative embodiments will become apparent to those skilled in the art to which the present disclosure pertains without departing from its spirit and scope.

What is claimed is:

1. A zipper head assembly structure, comprising:

a sliding member including a sliding element, an elastic member, and a locking hook, the sliding element having a base portion, a first lateral wall portion, a second lateral wall portion, and a seat portion, wherein an inner surface of the seat portion is configured with at least one retaining block; and a pull member movably cooperating with the locking hook;

wherein the first lateral wall portion and the second lateral wall portion respectively extend upward from opposite side ends of the base portion, mutually corresponding to each other, and are connected to a front end of the base portion, and wherein the seat portion is disposed on the base portion and connected to a rear end of the base portion, and includes a through positioning opening located between the first lateral wall portion and the second lateral wall portion, and the elastic member is disposed on the seat portion to elastically abut the locking hook;

wherein one end of the locking hook has a positioning portion passing through the through positioning opening, another end of the locking hook has a retaining portion, and the at least one retaining block fixes the retaining portion in place;

wherein the elastic member has a first fixing portion fixed onto the seat portion, a second fixing portion fixed onto the seat portion, an exposed portion connected between the first fixing portion and the second fixing portion and exposed outside the seat portion, an elastic portion extending from the first fixing portion and an abutting portion extending from the elastic portion and abutting the locking hook, and the locking hook is movably disposed on the seat portion and movably contacts the abutting portion of the elastic member;

wherein a thickness of the elastic portion is smaller than a thickness of the first fixing portion for increasing an elastic coefficient that the elastic portion can provide, wherein the first fixing portion has a front fixing section, a rear fixing section connected to the elastic portion, and a middle fixing section connected between the front fixing section and the rear fixing section, a width of the rear fixing section is smaller than a width of the front fixing section, and the width of the middle fixing section gradually decreases from the front fixing section to the rear fixing section, wherein the rear fixing section has a first fixing section connected to the middle fixing section and a second fixing section connected between the first fixing section and the elastic section, the thickness of the elastic portion is smaller than a thickness of the first fixing section of the rear fixing section and a thickness of the second fixing section, and the thickness of the second fixing section gradually decreases from the first fixing section to the elastic portion.

2. The zipper head assembly structure according to claim 1, wherein the thickness of the first fixing portion, the thickness of the second fixing portion, and a thickness of the exposed portion are the same, the thickness of the elastic portion is the same as a thickness of the abutting portion, a width of the abutting portion is greater than or equal to a width of the elastic portion, and the locking hook has an even thickness.

3. The zipper head assembly structure according to claim 1, wherein the second fixing portion has a retaining body connected to the exposed portion and a concave body connected to the retaining body, a width of the retaining body is the same as a width of the exposed portion, and a width of the concave body is smaller than the width of the retaining body.

4. The zipper head assembly structure according to claim 1, wherein the seat portion has a front retaining section for fixing the front fixing section, a rear retaining section for fixing the rear fixing section, a middle retaining section connected between the front retaining section and the rear retaining section for fixing the middle fixing section and an auxiliary retaining section separated from the front retaining section for fixing the second fixing portion, a width of the rear retaining section is smaller than a width of the front retaining section, and a width of the middle retaining section gradually decreases from the front retaining section to the rear retaining section.

5. The zipper head assembly structure according to claim 1, wherein the at least one retaining block is opposite to the extending direction of the retaining portion, and the at least one retaining block contacts and abuts a rearmost end of the retaining portion.

6. The zipper head assembly structure according to claim 1, wherein an outer surface of the elastic member has a flat surface, a curved surface and an inclined surface, all of which face back to the locking hook, and the inclined surface is connected between the flat surface and the curved surface.

7. A zipper head assembly structure, comprising:

a sliding member including a sliding element, an elastic member, and a locking hook, the sliding element having a base portion, a first lateral wall portion, a second lateral wall portion, and a seat portion, wherein an inner surface of the seat portion is configured with at least one retaining block; and a pull member movably cooperating with the locking hook;

wherein the first lateral wall portion and the second lateral wall portion respectively extend upward from opposite side ends of the base portion, mutually corresponding to each other, and are connected to a front end of the base portion, and wherein the seat portion is disposed on the base portion and connected to a rear end of the base portion, and includes a through positioning opening located between the first lateral wall portion and the second lateral wall portion, and the elastic member is disposed on the seat portion to elastically abut the locking hook:

wherein one end of the locking hook has a positioning portion passing through the through positioning opening, another end of the locking hook has a retaining portion, and the at least one retaining block fixes the retaining portion in place;

wherein the elastic member has a first fixing portion fixed onto the seat portion, a second fixing portion fixed onto the seat portion, an exposed portion connected between the first fixing portion and the second fixing portion and exposed outside the seat portion, an elastic portion extending from the first fixing portion and an abutting portion extending from the elastic portion and abutting the locking hook, and the locking hook is movably disposed on the seat portion and movably contacts the abutting portion of the elastic member;

wherein the second fixing portion has a retaining body connected to the exposed portion and a concave body connected to the retaining body, a width of the retaining body is the same as a width of the exposed portion, and a width of the concave body is smaller than the width of the retaining body.

8. A zipper head assembly structure, comprising:

a sliding member including a sliding element, an elastic member, and a locking hook, the sliding element having a base portion, a first lateral wall portion, a second lateral wall portion, and a seat portion, wherein an inner surface of the seat portion is configured with at least one retaining block; and a pull member movably cooperating with the locking hook;

wherein the first lateral wall portion and the second lateral wall portion respectively extend upward from opposite side ends of the base portion, mutually corresponding to each other, and are connected to a front end of the base portion, and wherein the seat portion is disposed on the base portion and connected to a rear end of the base portion, and includes a through positioning opening located between the first lateral wall portion and the second lateral wall portion, and the elastic member is disposed on the seat portion to elastically abut the locking hook:

wherein one end of the locking hook has a positioning portion passing through the through positioning opening, another end of the locking hook has a retaining portion, and the at least one retaining block fixes the retaining portion in place;

wherein the elastic member has a fixed portion fixed to the seat portion, an elastic portion extending from the fixed portion, and an abutting portion extending from the elastic portion and abutting against the locking hook, and the locking hook is movably disposed on the seat portion and movably contacts the abutting portion of the elastic member;

wherein a thickness of the elastic portion is smaller than a thickness of the fixed portion, the fixed portion has a front fixing section, a rear fixing section connected to the elastic portion, and a middle fixing section connected between the front fixing section and the rear fixing section, and the front fixing section, the rear fixing section, and the middle fixing section have the same width; wherein the thickness of the elastic portion is smaller than a thickness of the rear fixing section, and the thickness of the rear fixing section decreases gradually from the middle fixing section to the elastic portion, so as to form an inclined surface on an upper surface of the rear fixing section.

9. The zipper head assembly structure according to claim 8, wherein the inclined surface of the rear fixing section is connected to an upper surface of the elastic portion to form a non-curved surface, and a bottom surface of the rear fixing section is connected to a bottom surface of the elastic portion to form a continuous curved surface.

10. The zipper head assembly structure according to claim 8, wherein the inner surface of the seat portion is configured with another retaining block, and the two retaining blocks correspond to each other to fix two opposite sides of the retaining portion in position; wherein an end of the abutting portion has a slanted tip slidably contacting the locking hook for increasing the contact area between the abutting portion and the locking hook.

* * * * *